US007883262B2

(12) United States Patent
Voss

(10) Patent No.: US 7,883,262 B2
(45) Date of Patent: Feb. 8, 2011

(54) DEVICE FOR MANUFACTURING READY-TO-USE KNIFING FILLER BY MIXING A BINDER AND HARDENER COMPONENT

(75) Inventor: Klaus-W. Voss, Uetersen (DE)

(73) Assignee: Vosschemie GmbH, Uetersen (DE)

( * ) Notice: Subject to any disclaimer, the term of this patent is extended or adjusted under 35 U.S.C. 154(b) by 447 days.

(21) Appl. No.: 12/152,448

(22) Filed: May 14, 2008

(65) Prior Publication Data

US 2008/0298167 A1 Dec. 4, 2008

(30) Foreign Application Priority Data

May 31, 2007 (DE) ..... 20 2007 007 782 U
Aug. 24, 2007 (EP) ..... 07016608
Nov. 19, 2007 (DE) ..... 20 2007 016 136 U
Mar. 25, 2008 (DE) ..... 20 2008 004 098 U

(51) Int. Cl.
*B01F 15/02* (2006.01)

(52) U.S. Cl. ..... 366/160.4; 366/172.1; 366/303; 366/305; 366/171.1

(58) Field of Classification Search ... 366/160.1–160.5, 366/168.1, 171.1, 172.1, 172.2, 176.1, 181.5, 366/302, 303, 305, 307, 325.1, 325.2; 422/135; 222/145.5, 145.6
See application file for complete search history.

(56) References Cited

U.S. PATENT DOCUMENTS 2,278,051 A * 3/1942 Ambrose ..... 241/97
2,965,362 A * 12/1960 Friedrich et al. ..... 366/169.1
2,995,346 A * 8/1961 Samples ..... 366/98
3,788,609 A * 1/1974 Toczyski ..... 366/289
3,912,234 A * 10/1975 Peter ..... 366/262
3,938,783 A * 2/1976 Porter ..... 366/98
4,090,695 A * 5/1978 Stone et al. ..... 366/76.2

(Continued)

FOREIGN PATENT DOCUMENTS

DE 203 07 518 9/2003

(Continued)

*Primary Examiner*—Charles E Cooley
(74) *Attorney, Agent, or Firm*—Lucas & Mercanti, LLP; Klaus P. Stoffel

(57) ABSTRACT

A device (100) for manufacturing ready-to-use knifing filler for spackling surfaces, in particular of motor vehicle bodies, by mixing a binder component and a hardener component to a pasty or fluid mixing material using a mixing device (1) consisting of a hollow cylindrical stator section and a rotor section rotatably accommodated, and an annular gap forming the mixing chamber formed between the rotor section and stator section. The device has a fixed base (101) with a supporting plate (104') that forms a filler head (104) for holding a supply tank (90) for the binder component and for three supply tanks (91, 92, 92') for the hardener component, and a first drive unit (102) to actuate the hydraulic cylinder for the supply tank (90) for the binder component and for two supply tanks (91, 92) for the hardener component, a second drive unit (250) for the mixing device (1) and a third drive unit (270) to actuate the plunger rod designed as a toothed rack, wherein all three drive units are combined in a control device (280), which is used to control a first running of hardener component for 1 second and a last running for 1 second, as well as the supply of binder component and other hardener components in the mixing device (1).

28 Claims, 23 Drawing Sheets

U.S. PATENT DOCUMENTS

| | | | | |
|---|---|---|---|---|
| 4,805,154 | A * | 2/1989 | Schneider | 366/303 |
| 4,976,547 | A * | 12/1990 | Hisanaga et al. | 366/170.3 |
| 5,450,368 | A * | 9/1995 | Kubota | 366/303 |
| 6,499,630 | B2 | 12/2002 | Mühlbauer et al. | |
| 2008/0068922 | A1* | 3/2008 | Voss | 366/134 |
| 2008/0291774 | A1* | 11/2008 | Voss | 366/151.2 |
| 2008/0298167 | A1* | 12/2008 | Voss | 366/152.6 |
| 2009/0140007 | A1* | 6/2009 | Voss | 222/135 |
| 2009/0161480 | A1* | 6/2009 | Voss | 366/132 |

FOREIGN PATENT DOCUMENTS

| | | | |
|---|---|---|---|
| DE | 202006014187 | | 2/2007 |
| EP | 1 570 805 | | 1/1970 |
| EP | 1 627 690 | | 2/2006 |
| JP | 8-187727 | * | 7/1996 |

* cited by examiner

FIG. 9
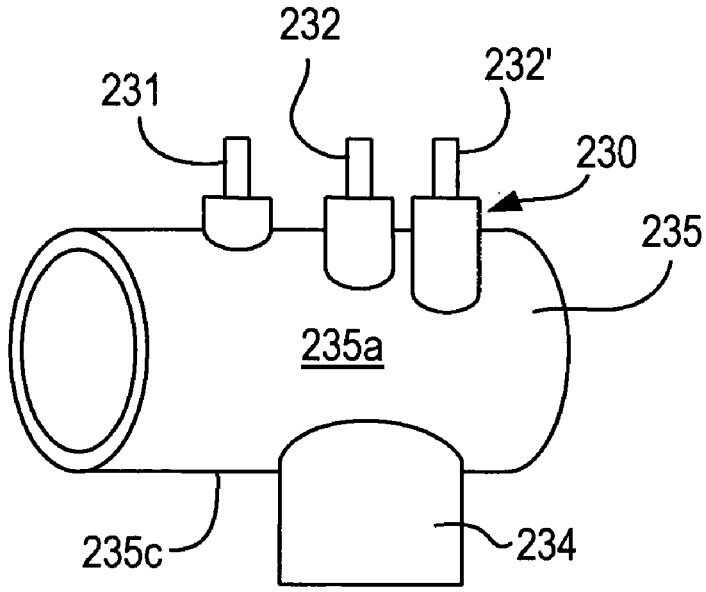
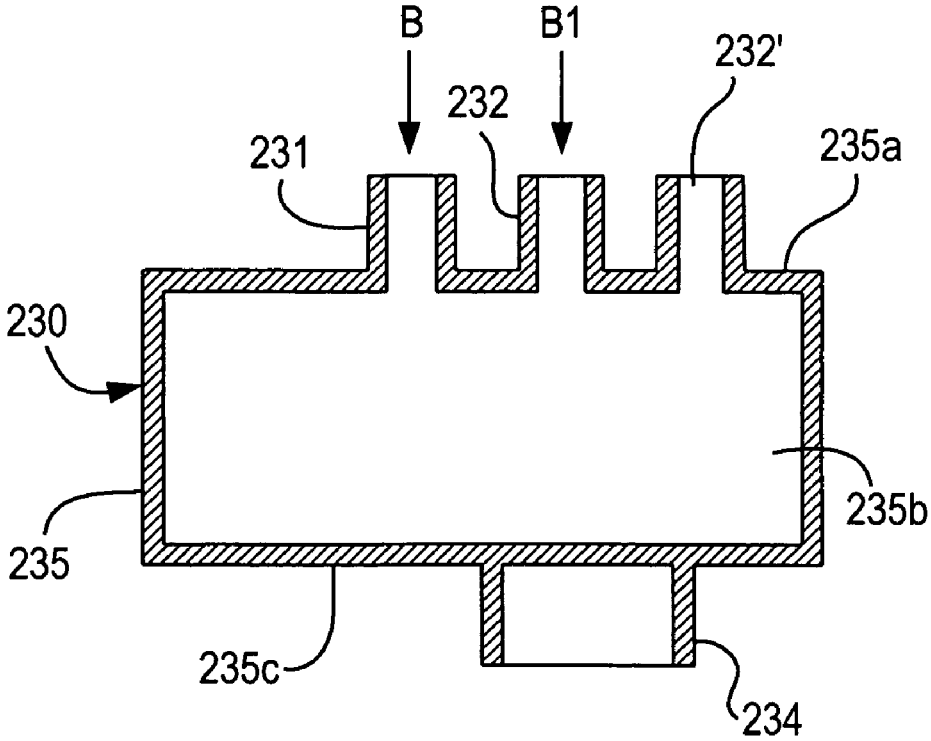
FIG. 10

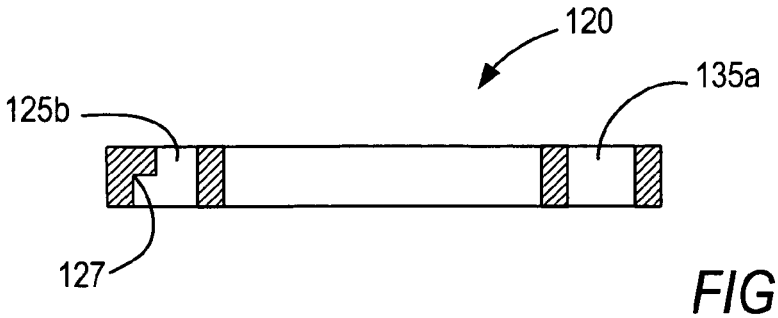
FIG. 14
FIG. 15
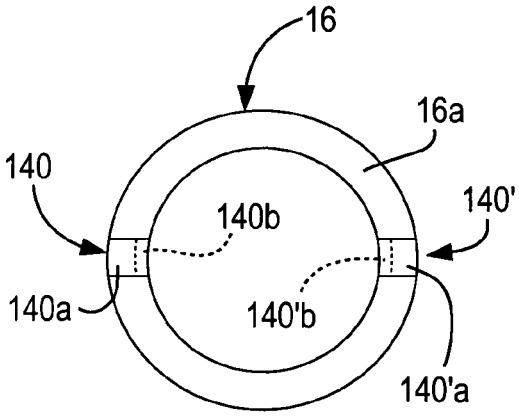
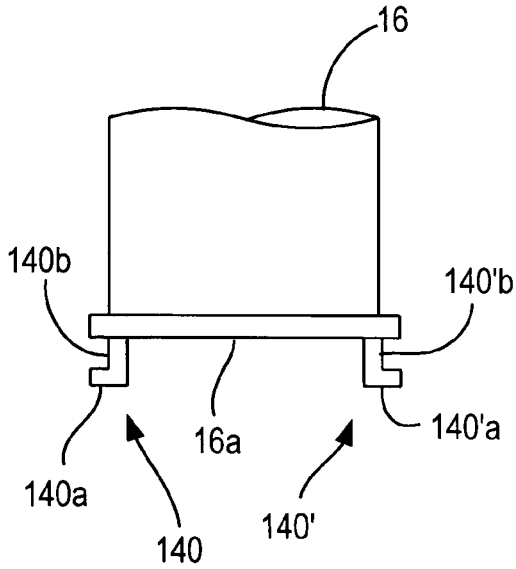
FIG. 16

DEVICE FOR MANUFACTURING READY-TO-USE KNIFING FILLER BY MIXING A BINDER AND HARDENER COMPONENT

BACKGROUND OF THE INVENTION

1. Field of the Invention

The present invention relates to a device for manufacturing ready-to-use knifing filler by mixing at least two components, in particular a binder component and a hardener component, to form a pasty or liquid mixture.

2. Description of the Related Art

Such devices for mixing at least two components are used in manufacturing knifing filler, for example, wherein a hardener component is mixed with 1-2% of a binder component to generate curable knifing filler. The mixing device has inlet holes for introducing the respective components, through which the components are introduced into the mixing chamber. The components are stored in upstream receptacles such as cartridges or the like, wherein the mixing device is part of an arrangement for providing knifing filler.

DE 203 07 518 U1 discloses such a device for manufacturing ready-to-use knifing filler for spackling surfaces, for example of motor vehicle bodies. The device has two containers situated on a base station, of which one is filled with a binder component, specifically a knifing filler component, and the other is filled with a hardener component. A metering device is used to continuously feed the two components via a respective supply channel to a mixing chamber, in which the components enter into contact with each other. The mixing chamber consists of a section of flexible tubing, gripped on the outside by press rollers that compress the section of tubing while simultaneously actuating it around a longitudinal axis. The resultant friction and adhesion of components to the inner wall of the tubing mixes the components. After the materials being mixed have passed through the section of tubing, they get to an outlet hole provided on the tubing, through which it continuously exits the tubing. The tubing wall consists of airtight plastic, so that the air around the tubing cannot get into the materials being mixed during the mixing process, and get trapped therein in the form of pores or voids.

Known from EP 1 627 690 is an adhesive gun for purposes of application, in particular of a two-component adhesive, which easily enables a broad range of mixing ratios between a relatively viscous adhesive component and a relatively fluid adhesive component in an adhesive gun. This adhesive gun encompasses a first cylindrical container provided with a first plunger for pressing a relatively viscous adhesive component out of a first cylindrical container, a second cylindrical behavior provided with a second plunger for pressing a relatively fluid adhesive component out of the second cylindrical container, a mixing unit into which the first cylindrical container and second cylindrical container empty, wherein the driving means are rated for velocity of the first plunger that exceeds the velocity of the second plunger, wherein the first cylindrical container has a larger inner diameter than the second cylindrical container.

EP 1 570 805 A discloses a device for generating a mixture out of several components, in particular for dental purposes. This device encompasses at least two cartridges, wherein each cartridge contains one component of the mixture comprised of several components and a plunger equipped to press the component out of the cartridge, and a drive unit for the plungers, in which the driving velocity can be set, wherein the drive unit has a stepping motor. At low revolutions per minute, the stepping motor is to provide a higher torque by comparison to known d.c. motors, while it also makes high revolutions per minute available, even if at a comparably low torque, which is sufficient for a rapid advance and retraction of the plungers.

U.S. Pat. No. 6,499,630 B discloses a device for the equally proportionate removal of two or more free-flowing substances from two or more syringes, of which at least one can also be used alone or in conjunction with other syringes, in particular for dental purposes. This device provides that both the syringe bodies and syringe plungers can be rigidly coupled together in the feeding direction via detachable coupling devices. The coupling devices are here designed in such a way that the plungers and/or syringe bodies can be joined in any position relative to each other in the feeding direction. Further, this device provides that the syringe bodies can only be coupled together in a predetermined relative position, while the plunger rods belonging to the plungers can be coupled together in any relative position.

However, practice has shown that the knifing filler mixed with the device occasionally still exhibits inhomogeneities. During application of the knifing filler on the surface of a motor vehicle body, the knifing filler does not cure in locations where no hardener component is present. Eliminating such defects is associated with a relatively high outlay, since the knifing filler must be removed from the body via grinding, whereupon the body must be spackled again. If such defects go unnoticed during a repair, and the body is thereafter painted, it even becomes necessary to paint the spot again. If the mixing device is not operated for an extended period of time, the knifing filler can dry and cake, especially in the end area of the ducting, which renders the device useless. In addition, the ducting is exposed to considerable wear, since significant flexing work is introduced into the tubing during operation of the device. Further, the device is very expensive and space-intensive owing to the press-rollers or rolls.

Another disadvantage has to do with the fact that adding the hardener component cannot be subjected to a visual inspection, so that a uniform supply of hardener component and binder component to the mixing device is not ensured.

SUMMARY OF THE INVENTION

Therefore, the object of the present invention is to provide a device for mixing a binder component and a hardener component to form a mixing material in which a portion of the hardener component is fed to the mixing device in advance of the binder component and other hardener components, so that a small quantity of hardener component is already present in the mixing chamber of the mixing device as the binder component enters the mixing chamber. In addition, the fill heights in the supply tanks for the binder component and hardener component are to be balanced out, so as to be able to proceed from the same surface heights for both the hardener component and binder component in their supply tanks when the two components are being tapped from the supply tanks.

In accordance with the present invention, the device for manufacturing ready-to-use knifing filler for spackling surfaces, in particular of motor vehicle bodies, by mixing at least two components, in particular a binder component A and a hardener component B, using a mixing device consisting of a hollow cylindrical stator section and a rotor section accommodated therein so that it can rotate concentrically around a longitudinal axis, and an annular gap forming the mixing chamber formed between the rotor section and stator section to a pasty or fluid mixing material, wherein the mixing device is provided with at least one inlet nozzle for supplying the binder component A and at least one additional inlet opening for supplying the hardener component B, as well as with a discharge opening for discharging the mixing material, wherein the mixing chamber is located between the inlet nozzle and discharge opening, in which components A, B are mixed together, a fixed base with two perpendicularly standing, columnar braces connected by a transverse brace in the upper area, between which is situated a filler head that forms a support plate and has mounts and receptacles for a supply tank for binder component A and for three supply tanks for hardener components B, B1, B2 with plunger rods guided in the supply tanks and connected with hydraulic cylinders, wherein there are provided an attachment and guiding element for the plunger rods above the supply tanks, and a first drive unit for actuating the hydraulic cylinders or plunger rods for the supply tank for binder component A and for two supply tanks of the three supply tanks for hardener components B, B1, B2, and a second drive unit for the mixing device, and a third drive unit for actuating the hydraulic cylinder or plunger rods for the third supply tank for hardener component B2, wherein the three motorized drive units are combined in a program controller or control device in such a way that, prior to the start of the mixing process and actuation of the hydraulic cylinders or plunger rods for the supply tank for binder component A and for the two supply tanks for binder components B, B1, the third drive unit for the third supply tank for hardener component B2 is put into operation independently of all other functions, so that the start of the of the actual mixing process is preceded by a first running of hardener component B2 for about 1 second, wherein once the rotor section of the mixing device has begun to rotate and binder component A and hardener components B, B1 start to be supplied, the third drive unit for the third supply tank for hardener component B2 is operated for an additional 1 second of last running to supply more hardener component B2, wherein, following the complete evacuation of the third supply tank for hardener component B2 and once a toothed rack as the plunger rod driven by the third drive unit situated in a box-like container on the transverse brace of the two braces of the fixed base has reached the lower area of the third supply tank for hardener component B2, it continues moving downward, hoisting the box-like container hinged on one side to the longitudinal brace in such way as to lift the box-like container roughly 2 mm, wherein this movement of the box-like container activates an optical signaling device and deactivates the entire device for changing out the empty third supply tank for hardener component B2 for a full supply tank.

In another embodiment, the fixed base of the device exhibits a filler head designed as a support plate for holding the supply tank for binder component A and the three supply tanks for hardener components B, B1, B2, wherein the four supply tanks are positioned skidproof or immovably secured onto the filler head, and their outlet openings correspond to inlet openings of supply channels in the filler head, the outlet openings of which can be made to actively interact with the inlet nozzles for binder component A and for hardener components B, B1, B2 of the mixing device, or with the inlet nozzles for hardener components B, B1, B2 of a collection tank that can replace the mixing device for collecting and disposing the quantity of hardener components B, B1, B2 caused by overflow in the supply tanks for hardener components B, B1, B2, and wherein the interiors of the supply tanks exhibit the plate-shaped plungers that act on the container contents, with plunger rods that can be moved in the longitudinal direction of the container by means of motorized hydraulic cylinders or drive units of another design, or through manual activation, and can be used to force the contents in the supply tanks for binder component A and for hardener components B, B1, B2 into the mixing device, or partial contents of the supply tanks for hardener components B, B1, B2 into the collection tank.

In addition, the invention here proceeds from the fact that the fill heights for hardener component B and binder component A in their supply tanks differ, so that the mixing ratios between the two components obtained at the start of the tapping process reflect a larger quantity of hardener component, so that a prescribed and even required mixing ratio is not obtained. This is because it is absolutely necessary, already at the start of tapping the components from their supply tanks in a quantity required for mixing purposes, that the surface height of both binder component A in its supply tank and hardener component B, B1 in their supply tanks be precisely equalized. For this reason, the fill heights over the supply tanks for hardener components B, B1 are greater than the fill height of binder component A in its supply tank. In most instances, this excess fill level measures about 10 mm. When using a new supply tank for binder component A and supply tanks for hardener components B, B1 in the mixing device, equilibrium can initially be established between all three components A, B, B1. This is done by manually actuating a handle provided on the plunger rods, with which the plunger rods are moved into the supply tanks for hardener components B, B1 until the excess quantity of hardener component B, B1 has been forced out of the supply tanks, and introduced into the collection tank incorporated into the device. The handle is here actuated until the plate-shaped plunger has acted upon the supply tank for binder component A; at that point, the excess quantity of hardener components B, B1 has also been forced out.

In order to bring the fill level of hardener components B, B1 to the fill level of binder component A, the pull-lever handle of the device is moved to half the height of the plunger rods or compressed air cylinder. After installing the new supply container for binder component A and the two cartridge-like supply tanks for hardener components B, B1 into the device, the handle is pushed down forcibly, i.e., with about 30 kg, specifically until such time as it can no longer move. All fill levels are then equalized. Since binder component A has a far higher viscosity than hardener component B, B1, and the size of the surface of binder component A makes up 98% of the overall surface in its supply tank, binder component A cannot be forced out of its supply tank under a manually applied force, because binder component A requires a force of about 2 bar to exit below from the outlet opening of the supply container or outlet opening of the filler head. In a 10 kg supply tank for binder component A, a pressure of 0.15 bar is exerted on binder component A. Of course, this is insufficient for transporting binder component A, since 400 kg of tensile force are required for this purpose. This is not achievable. In a 3 kg supply tank for binder component A, a pressure of 0.4 bar is exerted on binder component A with 30 kg of tensile force. This is also not enough to force binder component A out of its supply container into the mixing device. Therefore, manual force is never sufficient to force out binder component A. To eliminate the excess in supply tanks for hardener components B, B1, the connecting pipes of the collection tank are inserted into the outlet openings of the filler head of the device for hardener components B, B1, whereupon the handle is pulled down with as much force as possible. This establishes the functional readiness for the mixture with the device and its mixing device. The collection tank that accommodates the overfilled quantity of hardener component B, B1, is then replaced with the mixing device, so that the mixture of binder component A and hardener components B, B1 can be prepared. No overfill levels need to be eliminated for any subsequent mixtures, which would only be the case when incorporating new supply tanks for binder component A and hardener components B, B1 in the device.

In one embodiment of the invention, the collection tank consists of a molded part having a cup-shaped, cylindrical or some other geometric cross section, and is closed on one side, wherein its wall exhibits two adjacent connecting pipes connected with the interior of the molded parts, which are arranged and designed in such a way that the collection tank can be affixed to the filler head via the connecting pipes that can be inserted into the outlet openings of the filler head for hardener components B, B1. If the collection tank is no longer required, the collection tank is removed from the filler head, and the mixing device is attached.

The wall surface of the molded part of the collection tank opposite the two connecting pipes exhibits a connecting pipe, into which the clamping device provided on the device or the drive shaft for the mixing device engage to hold and center the collection tank.

The mixing device has a hollow cylindrical stator section and a rotor section accommodated therein so that it can concentrically rotate around a longitudinal axis, wherein the mixing chamber is formed between the stator section and rotor section as an annular gap, with several first mixing teeth molded onto the stator section extending radially inward, and several second mixing teeth molded onto the rotor section extending radially outward into the mixing chamber, so that the rotational motion of the rotor section in the stator section moves the mixing teeth against each other, mixing components A, B, B1, B2, wherein the stator section exhibits three inlet openings connected with the mixing chamber for hardener components B, B1, B2.

The end of the stator section facing away from the inlet openings carries an annular mount, which has attachment openings, and is detachably and rotatably attached with the stator section like a bayonet catch, wherein the rotating ability is limited by stops in such a way as to make the inlet opening for binder component A fit the feeder for binder component A, and simultaneously make the inlet openings for hardener components B, B1, B2 fit the feeders for these components.

This annular mount exhibits two opposing slotted openings that curve parallel to the circumferential edge of the mount, wherein each slotted opening exhibits two guiding sections of varying width, of which the respectively wider guiding section is designed for introducing an L-shaped guiding cam molded onto the lower circumferential edge of the stator section, while the width of the wider guiding section corresponds to the length of the free, angled leg of the guiding cam, and of which the respectively narrower guiding section exhibits a width corresponding to the thickness of the leg of the L-shaped guiding cam molded onto the lower circumferential edge of the stator section and running parallel to the longitudinal direction of the mixing device.

In one advantageous embodiment of the present invention, the inlet openings empty directly into the mixing chamber of the mixing device, wherein the inlet opening for supplying the hardener is available in three places, so as to ensure a redundant supply to the mixing material of the hardener component, and make it possible to feed hardener component B2 from the third supply tank to the mixing chamber of the mixing device with first runnings and last runnings. The requirement for a redundant supply of hardener component is based on the knowledge that inhomogeneities in the mixing material are normally caused by air pockets in the hardener component, which cannot be reliably avoided in practice even given careful manufacture of the hardener component. Since the hardener component makes up less than 5%, and preferably only about 2%, of the total volume of the mixing material, the smallest air pockets in the hardener component can already result in the mixing material having areas that contain no hardener component, and hence do not cure. Because two supply tanks are preferably provided for the hardener component in the device according to the invention, and joined with the mixing chamber via separate supply channels, the hardener components can still continue to be supplied to the mixing chamber via the second supply channel in cases where one of the supply channels contains an air pocket. The danger of air pockets in the hardener component being present in all supply channels simultaneously is many times less, and can hence be disregarded. For example, the device can be used for the following binder systems: Polyester resins (unsaturated), peroxide-styrene systems, epoxy resins (two-component), polyurethane-resin systems (two-component), phenol resin systems, silicone systems (two-component), acrylate systems (two-component) or Thiocoll systems (polydisulfide systems).

In order to be able to control the supply of hardener component B, B1, B2 through visual inspection, it is provided that at least the stator section be made of a transparent material, wherein the transparent material comes from the group of plastics encompassing a polycarbonate (PC), a polymethylmethacrylate (PMMA) and/or a styrene-acrylonitrile (SAN). It remains especially advantageous to dye the hardener components. The transparent stator section makes the supply of hardener component visible, so that users can monitor the supply of hardener component with their own eyes during operation of the mixing device.

Another advantageous embodiment of the invention provides that the first mixing teeth are arranged on at least one first mixing tooth plane, and the second mixing teeth are arranged on at least one second mixing tooth plane, and that the mixing tooth planes are axially staggered relative to each other in levels in the direction of the longitudinal axis, so that the second mixing teeth of the rotor section radially rotate in the respective gaps of the first mixing teeth of the stator section. A total of five mixing tooth planes can be provided for the first mixing teeth of the stator section, so that the second mixing teeth of the rotor section in the respective gaps are arranged on a total of four mixing tooth planes. Traveling from the inlet opening to the discharge opening, the mixing material runs through the total of five mixing tooth planes for the first mixing teeth, as well as the four mixing tooth planes of the second mixing teeth.

The mixing teeth advantageously each have front lateral surfaces that each face each other in an axial direction, so as to be positioned relative to each other given an axial force between the stator section and rotor section. In addition, the front lateral surfaces are inclined at an angle $\alpha$ in relation to a plane situated normal to the rotational axis, so that the front lateral surfaces glide against each other during the mixing process without the mixing teeth stripping away material and allowing it into the mixing material. This makes it possible to keep the rotor section short in the direction of the rotational axis, so that only a corresponding residual quantity of mixing material remains in the mixing chamber following the use of the rotor section or stator section. As a result, the device enables a low consumption of components. During the mixing process, the mixing teeth of the rotor section and mixing teeth of the stator section are pressed against each other by the conveying pressure of the components, during which the mutually inclined front lateral surfaces slide against each other, without the teeth abrading material and allowing it into the mixing material.

The components of the mixing material here form a thin film between the front lateral surfaces gliding against each other that acts as a sliding layer. The angle α by which the mixing teeth are inclined against each other relative to the normal to the rotational axis can measure at least 5°, possibly 10° and preferably at least 15°.

Another advantageous embodiment of the invention provides that the stator section encompasses a support bearing surface, against the face of which the rotor section with molded-on mixing teeth abuts and slides to create an axial sliding bearing arrangement. The rotor section is initially introduced into the stator section via an open end side facing away from the inlet openings, until it hits the support bearing surface with the mixing teeth. This permits a unilateral axial bearing of the rotor section in the stator section. The rotor section geometry is adjusted in such a way that the second mixing teeth of the rotor section come to line in the respective gaps of the first mixing teeth of the stator section as the mixing teeth hit the support bearing surface on the front. The axial support of the rotor section takes place in the bonding direction of the rotor section in the stator section against the support bearing surface, wherein an axial clearance toward the opening of the stator section creates a danger that the first and second mixing teeth will come into contact with each other. The front lateral surfaces arranged at an angle α cause the rotor section to be returned against the support bearing surface in the bonding direction from which the rotor section is inserted into the stator section.

In another advantageous embodiment of the device, the supporting frame of the device exhibits an openable, preferably transparent protective cover to cover the supply tanks, wherein it is especially preferred to have a protective switch that interacts with the protective cover and device, which deactivates the device if the protective cover is open, wherein the latter can consist of a clear plastic or other suitable material, and is designed as a door.

In addition, the supporting frame of the device has receiving tanks front and/or back for holding spent or new mixing devices.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 9 is a diagrammatic view of the collection tank;

FIG. 10 is a perpendicular longitudinal section though the collection tank;

FIG. 14 is a perpendicular section according to the XIV-XIV line on FIG. 12;

FIG. 15 is a bottom view of the stator section of the mixing device, with the guiding cams that engage the mount;

FIG. 16 is a side view of a part of the stator section with the molded-on guiding cams;

DESCRIPTION OF THE PREFERRED EMBODIMENTS

Figure 1:
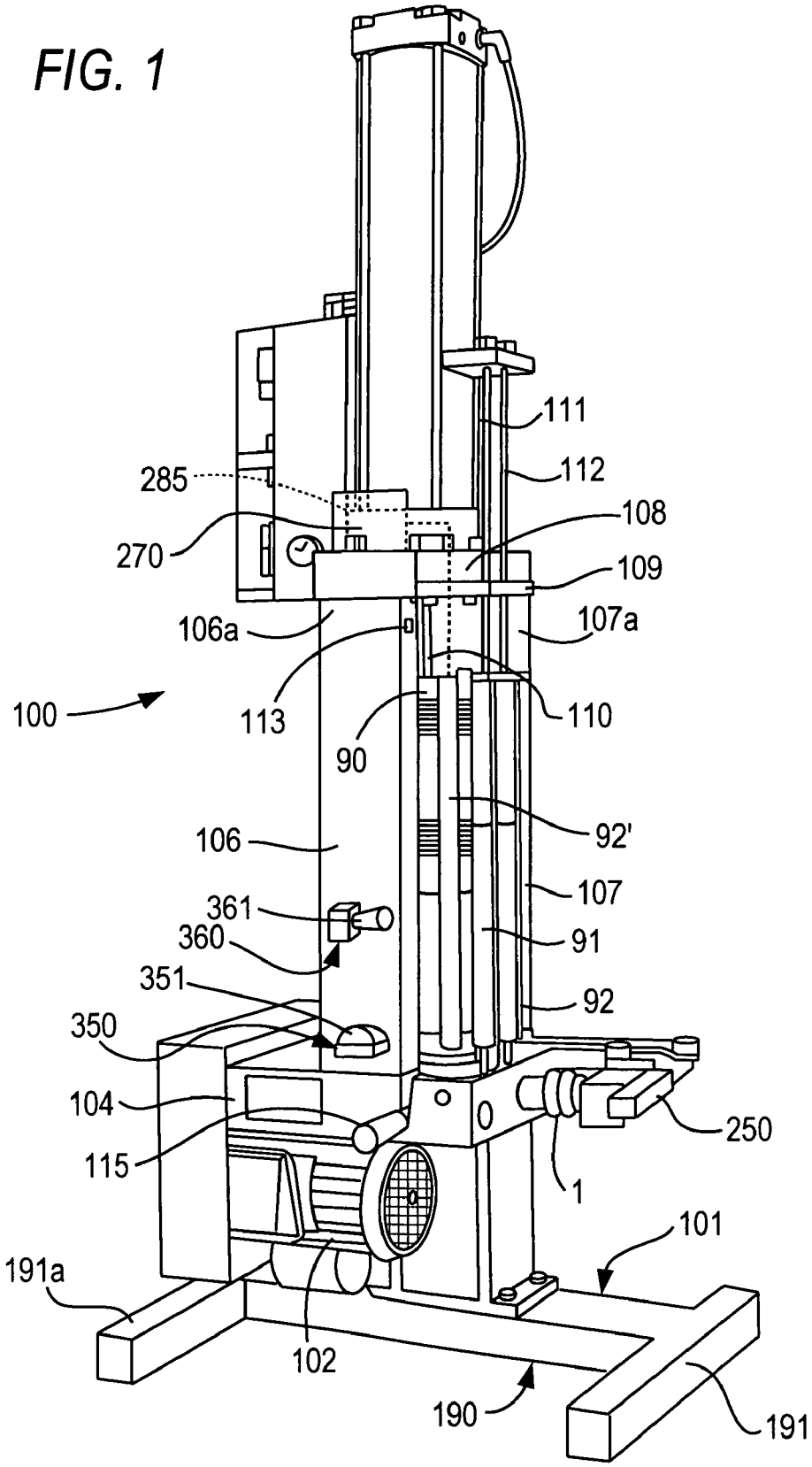
FIG. 1 is a diagrammatic view of a device according to the invention for manufacturing ready-to-use knifing filler to spackle surfaces, for example, of motor vehicle bodies, with an arrangement for mixing two components consisting of a stator section and rotor section, wherein both sections exhibit intermeshing mixing teeth.
Figure 1A:
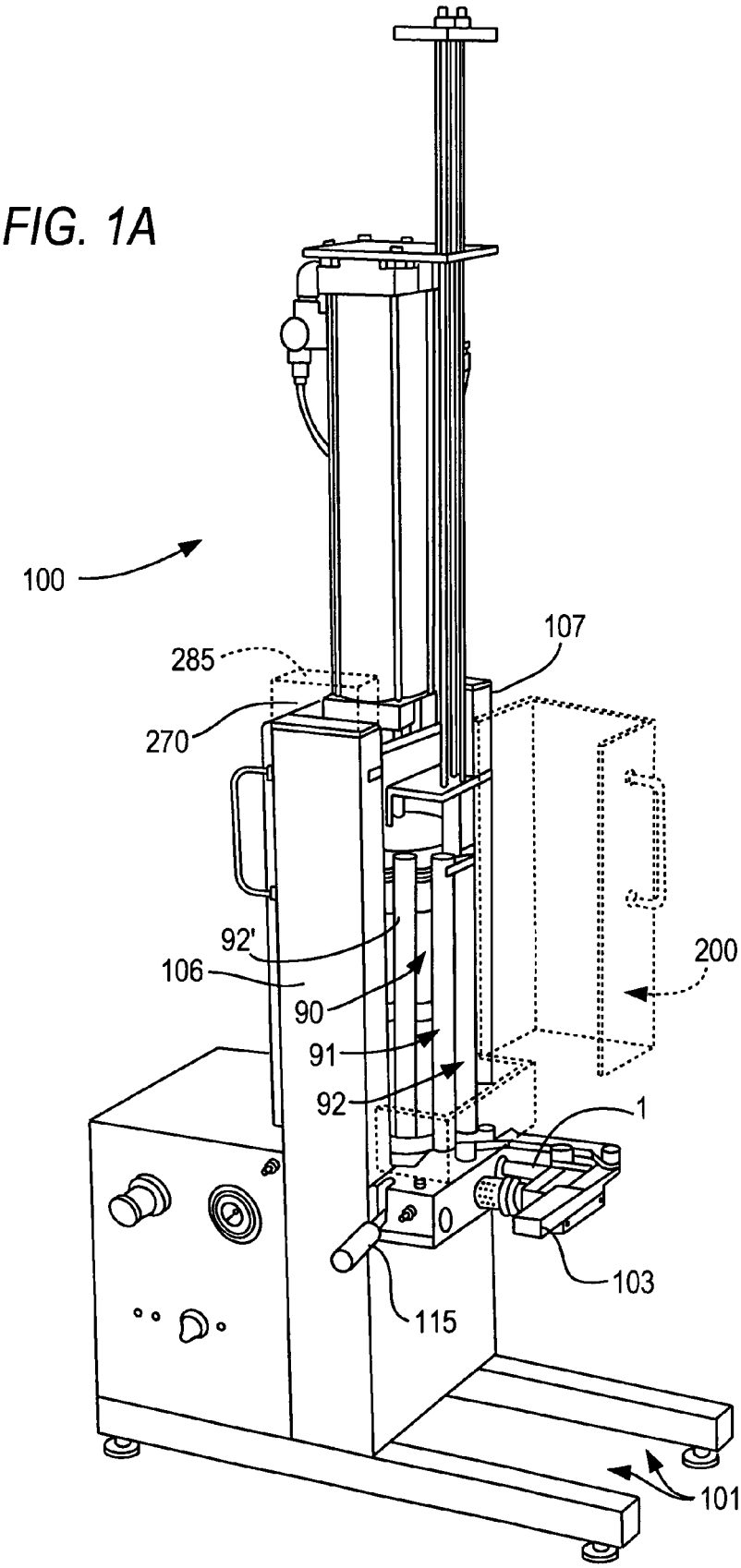
FIG. 1A is a diagrammatic view of the device with a mount consisting of two columns joined by means of a cross brace for the plunger rods and their driving units for the supply tanks for the binder component, and for the hardener component, and with an opened protective cover.
Figure 1B:
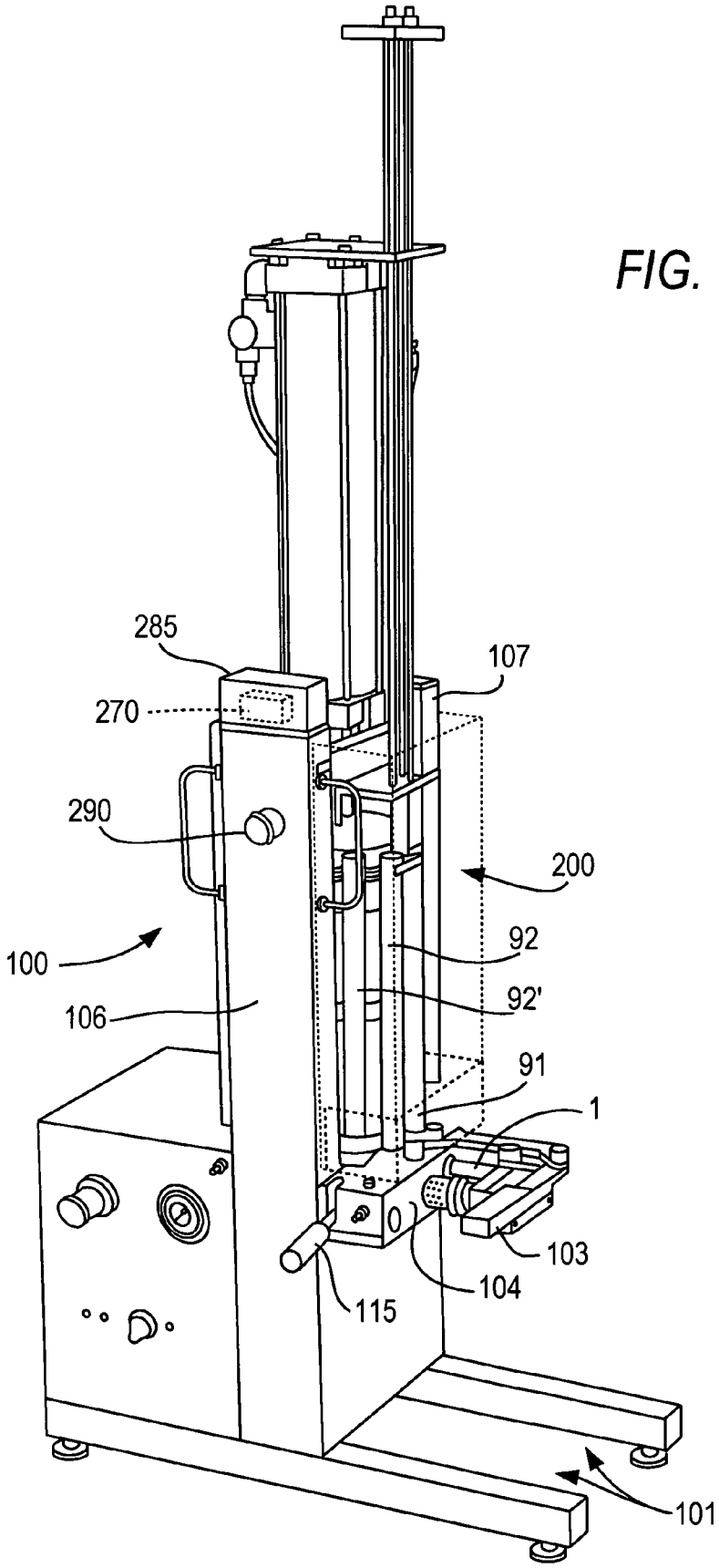
FIG. 1B is a diagrammatic view of the device with a mount consisting of two columns joined by means of a cross brace for the plunger rods and their driving units and with the closed protective cover.
Figure 4:
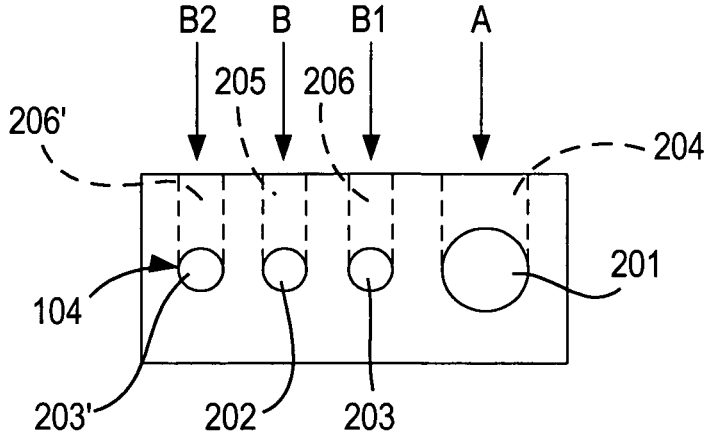
FIG. 4 is a front view of a filler head with the outlet openings for the binder component and the two hardener components.
Figure 5:
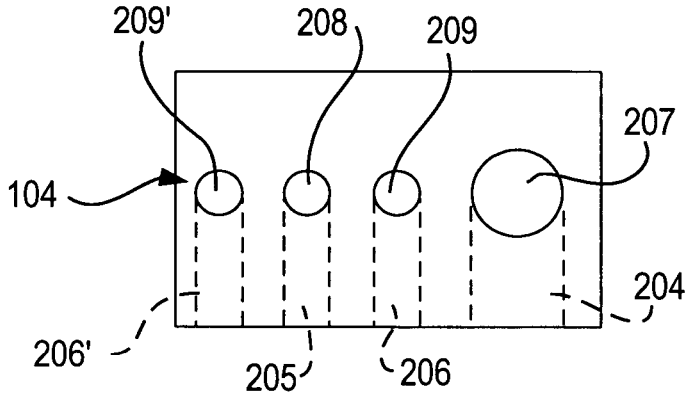
FIG. 5 is a top view of the filler head with the inlet openings for the two hardener components.
Figure 17:
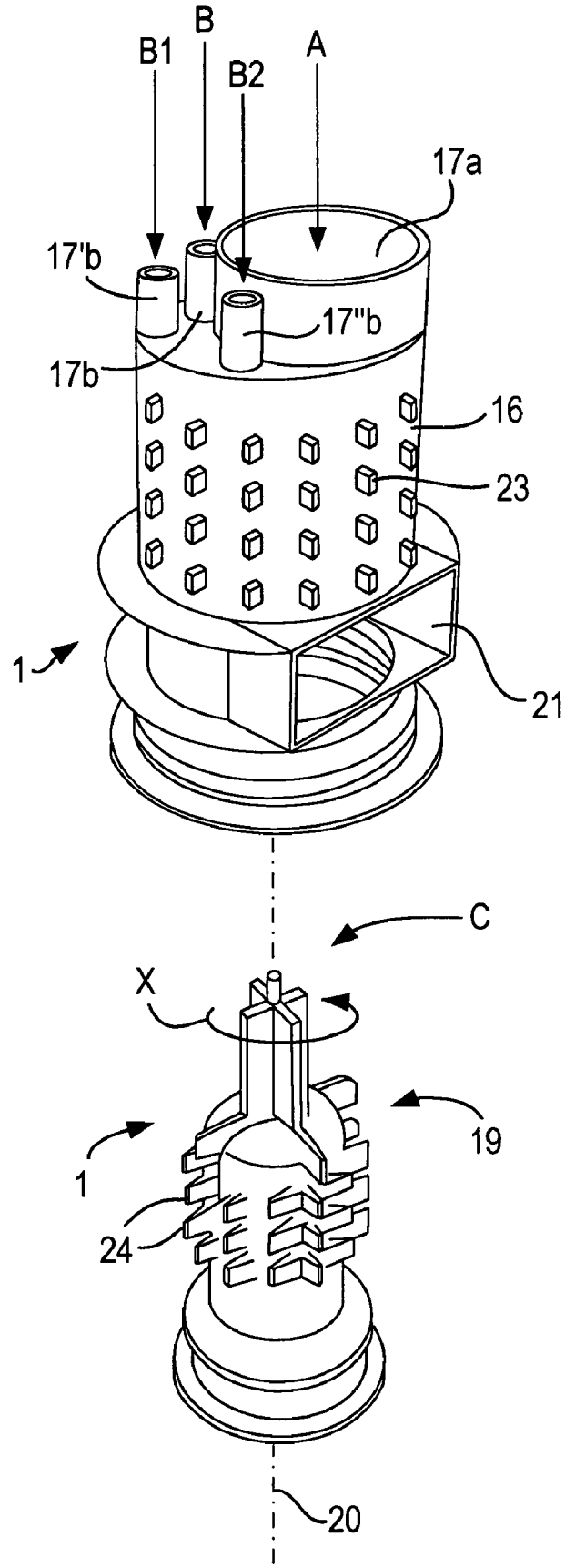
FIG. 17 is a diagrammatic exploded view of the mixing device with the stator section and rotor section.
Figure 18:
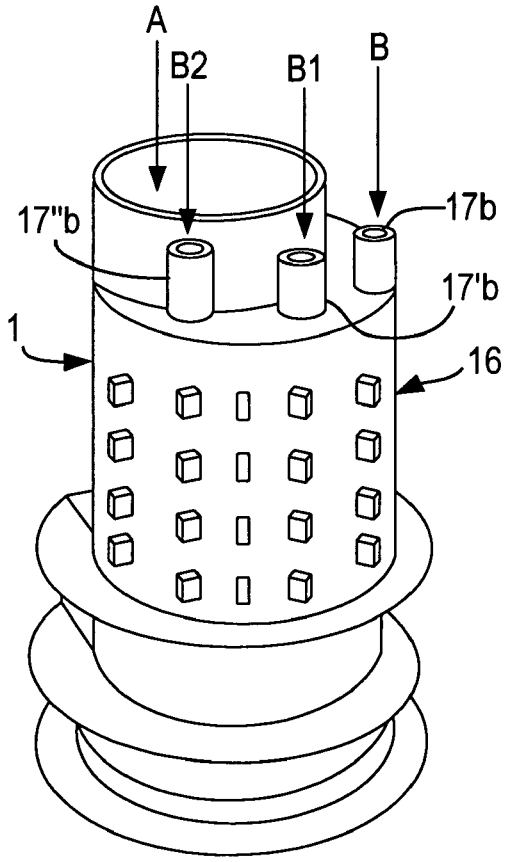
FIG. 18 is a diagrammatic view of the stator of the mixing devices with the feed lines for the binder component and the hardener component.
Figure 19:
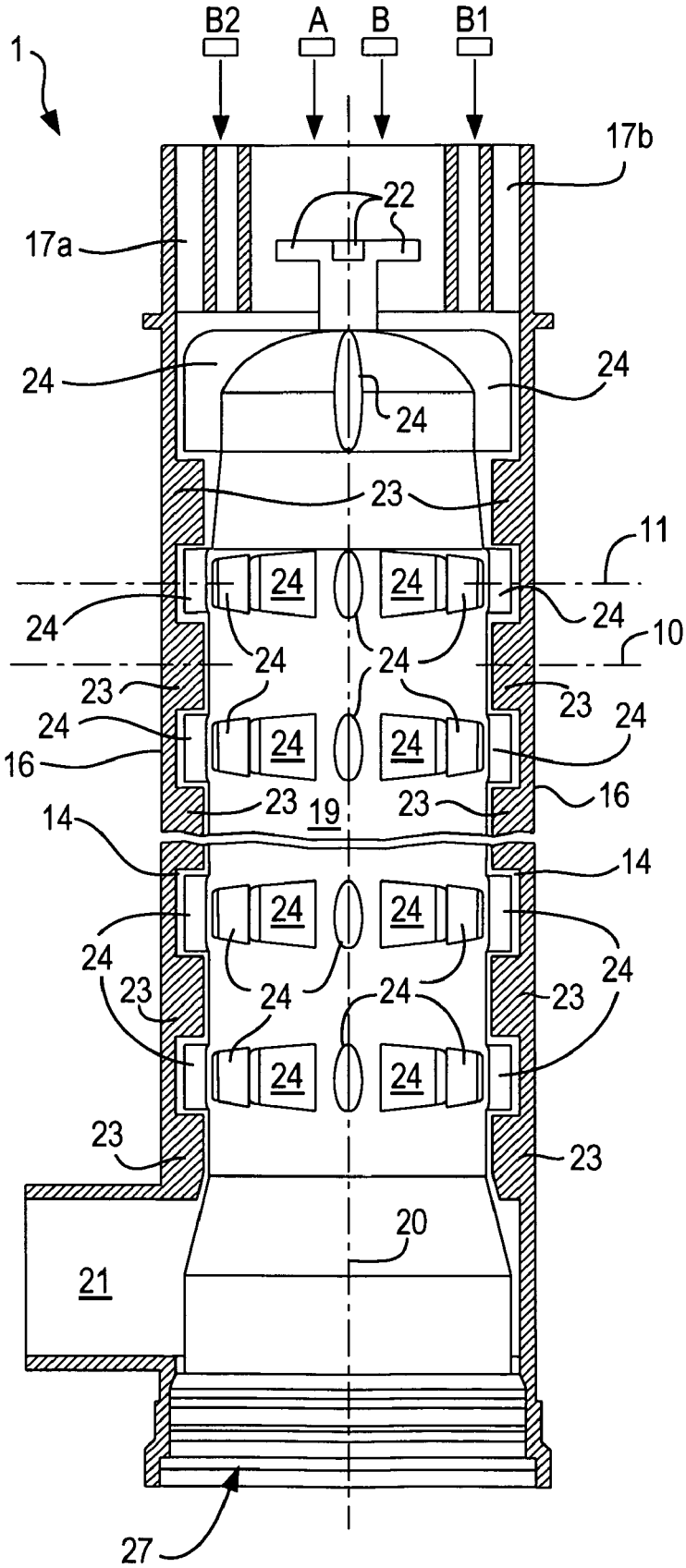
FIG. 19 is a view of the mixing device in which the rotor section is incorporated in the stator section, and the stator section is shown cut.

The device 100 shown on FIG. 1 for manufacturing ready-to-use knifing filler to spackle surfaces, for example those of motor vehicle bodies, consisting of a binder component A and a hardener component B, encompasses a fixed base 101 with a first drive unit 102 and a mount 103 for a mixing device 1, which consists of a stator section 16 and a rotor section 19 FIG. 17), wherein an annular gap forming the mixing chamber 14 is established between the two cylindrical sections 16 and 19. The mount 103 with handle 103*a* simultaneously accommodates a second drive unit 250 for the mixing device 1 (FIGS. 1, 1E and 1F). The fixed base 101 consists of two perpendicular, columnar braces 106, 107, which are joined together in the area of their upper free ends by means of a cross brace 108. The filler head 104 designed as a support plate 104' is arranged between the perpendicular braces 106, 107 (FIG. 1A). This plate-shaped filler head 104 is simultaneously used as the carrying and support plate 104' to accommodate a supply tank 90 for the binder component A and, in the embodiment shown on FIGS. 1B, 1C and 2, three supply tanks 91, 92, 92' for hardener components B, B1, B2. The supply tanks 90, 91, 92, 92' are fixed in place on the filler head 104 so they cannot slip. The outlet openings of the supply tanks 90, 91, 92, 92' correspond with the inlet openings 207, 208, 209, 209' of supply channels 204, 205, 206, 206' in the filler head 104 (FIG. 2), wherein these supply channels are in turn joined with the inlet nozzles 17*a*, 17*b*, 17'*b*, 17"*b* of the mixing device 1 with the device 100 in operation. As a result, the outlet openings of the supply thanks 90, 91, 92, 92' correspond with the inlet openings 207, 208, 209, 209' of the supply channels 204, 205, 206, 206' formed in the filler head 104, the outlet openings of which are marked 201, 202, 203, 203' (FIGS. 3, 4 and 5).

The fixed base 101 most preferably consists of a double-T profile 101*a*, 101*b* or two capping pieces that run toward each other and are joined via the device itself (FIG. 1A).

The four supply tanks 90, 91, 92, 92' are fixed in place on the filler head 104 so that they cannot slip.

Figure 3:
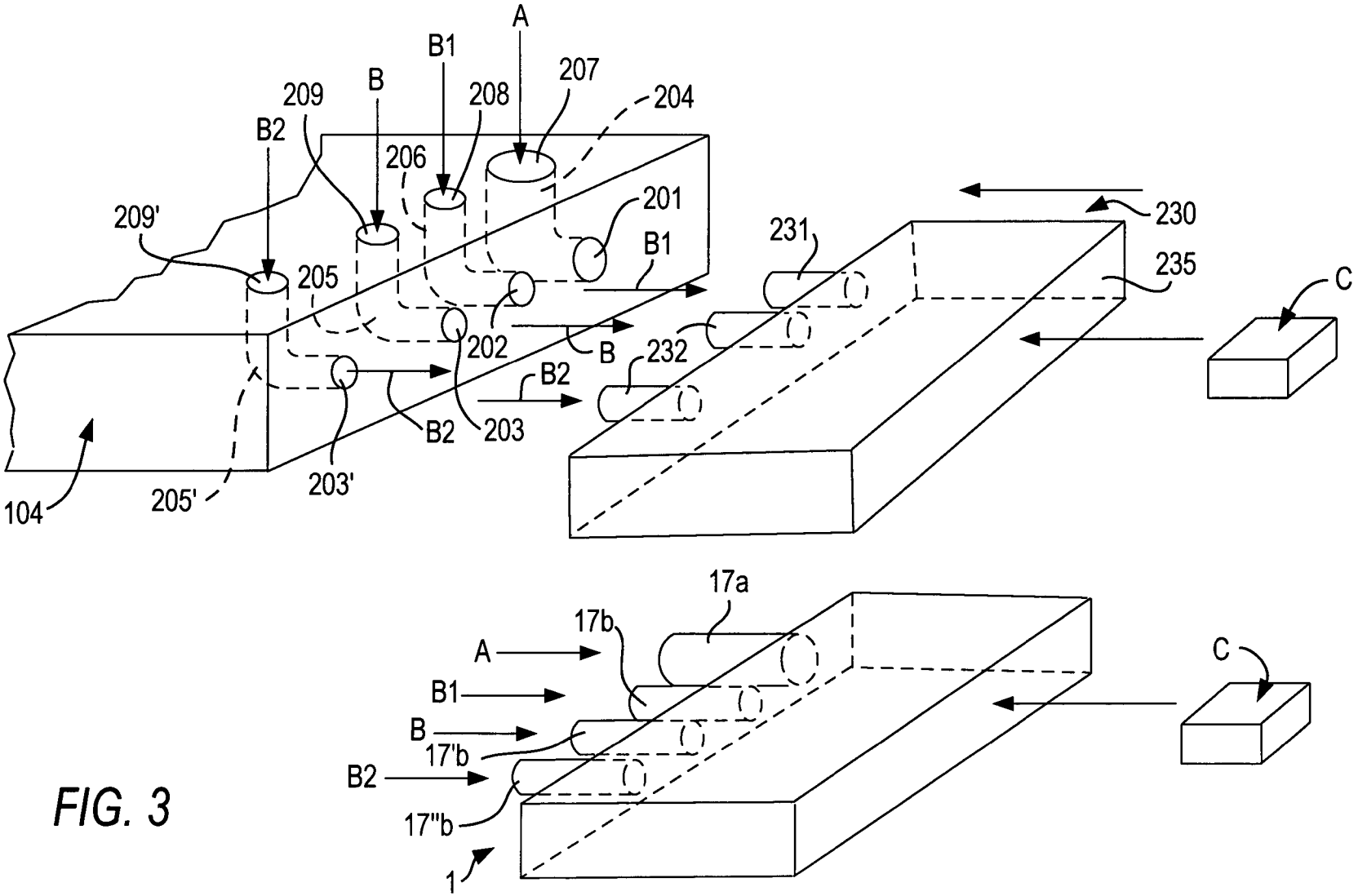
FIG. 3 is a diagrammatic view of a filler head designed as a support plate for the supply tanks designed for the binder component, with inlet and outlet openings, inlet openings for the components and outlet openings connected by supply channels with the inlet openings, wherein the filler head has allocated to it a mixing device and collection tank for holding quantities of hardener components generated when supply tanks are overfilled with hardener components.
Figure 8:
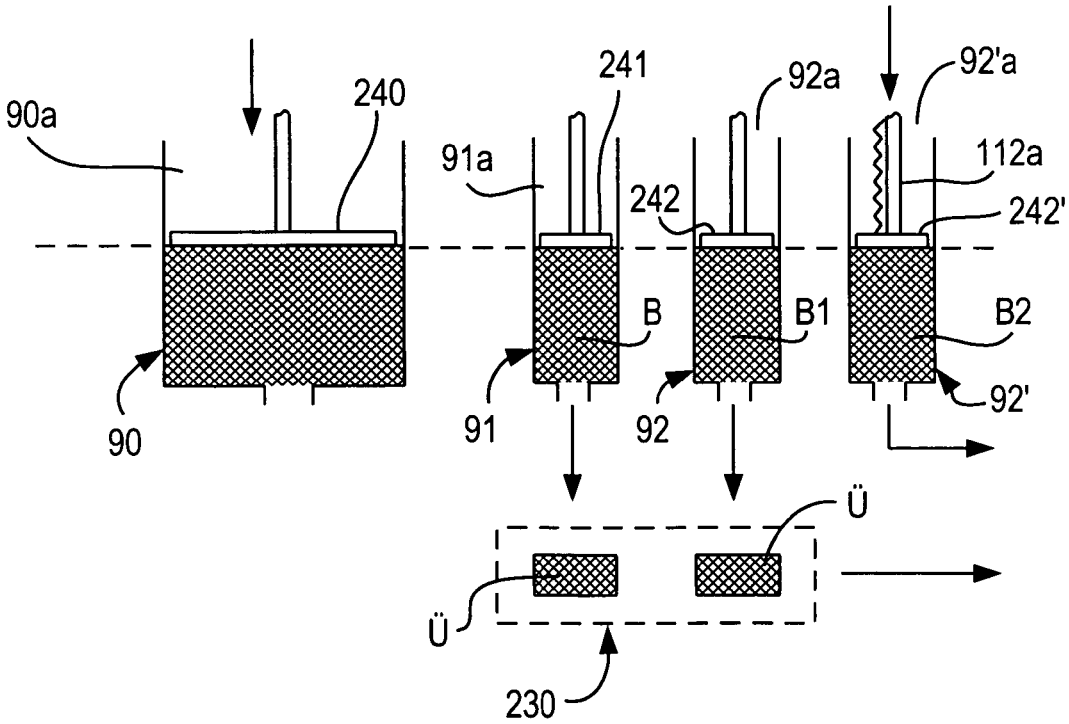
FIG. 8 is a combination view and perpendicular section of the supply tank for the binder component and the two supply tanks for the hardener components after the overfilled hardener components have been forced out of their supply tanks, wherein the quantity of overfilled hardener component forced out of the supply tanks [is relayed] to the collection tank.

The outlet openings 201, 202, 203, 203' of the supply channels 204, 205, 206, 206' are joined with the inlet nozzles 17*a*, 17*b*, 17'*b*, 17"*b* for the binder component A and hardener components B, B1, B2 of the mixing device 1, or the inlet nozzles 231, 232, 232' for the hardener components B, B1, B2 of a collection tank 230 can replace the mixing device in order to receive and dispose of the overfilled quantity of hardener components B, B1, B2 in the supply tanks 91, 92, 92' for the hardener components B, B1, B2 (FIGS. 3, 8 and 10).

Figure 7:
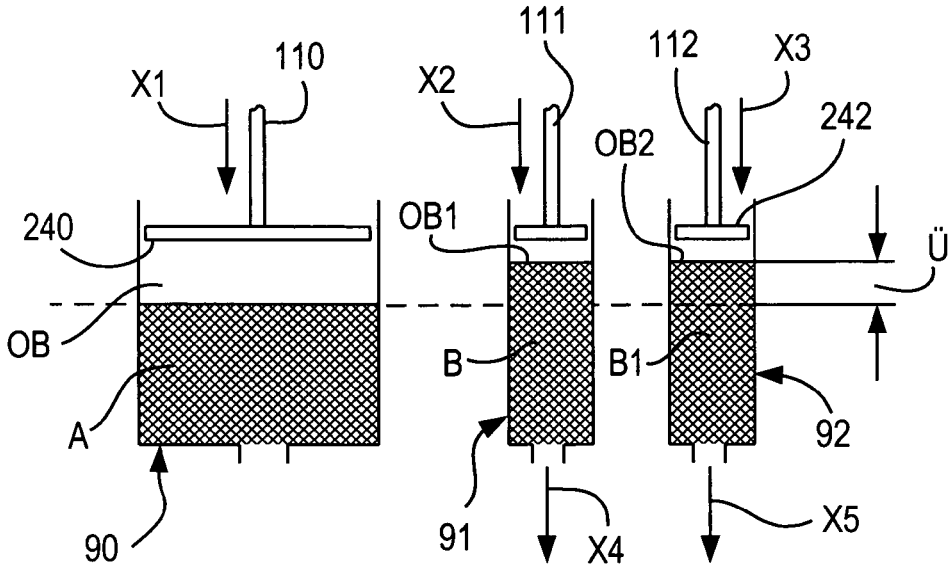
FIG. 7 is a combination view and perpendicular section of the supply tank for the binder component and the two supply tanks with overfilled hardener components relative to the binder component.

The interior spaces 90*a*, 91*a*, 92*a*, 92' of the supply tanks 90, 91, 92, 92' exhibit plate-shaped plungers 240, 241, 242, 242' that act on the tank contents, and have motorized hydraulic cylinders or otherwise designed drive units, or plunger rods 243, 244, 245, 245' that can be manually actuated to move in the longitudinal direction of the tank, thereby forcing the contents of the supply tanks 90, 91, 92, 92' for binder component A and hardener components B, B1, B2 in the mixing device 1, or partial contents in the supply tanks 91, 92, 92' for the hardener components B, B1, B2 into the collection tank 230 (FIGS. 7 and 8).

The collection tank 230 consists of a most preferably unilaterally closed molded part 235 with a beaker-shaped, cylindrical or other geometric cross sectional shape, whose wall 235*c* exhibits two adjacent connecting pipes 231, 232 joined with the interior space 235*b* of the molded part 235 for supplying hardener components, which are arranged and designed in such a way that the collection tank 230 can be attached to the filler head 104 by means of the connecting pipes 231, 232, 232' that can be introduced into the outlet openings 202, 203 of the filler head 104 for the hardener component B, B1, B2.

If hardener component is supplied to the filler head 104 from several supply tanks, the collection tank 230 exhibits a corresponding number of connecting pipes 231, 232, 232'.

A motorized hydraulic cylinder or several motorized hydraulic cylinders 110, 111, 112, 112' are used to operate plunger rods, the ends of which lying freely in the interior spaces 90*a*, 91*a*, 92*a*, 92'*a* of the supply tanks 90, 91, 92, 92' bear plate-shaped plungers 240, 241, 242, 242', so that, with the hydraulic cylinders 110, 111, 112, 112' in operation, the plunger rods with the plungers 240, 241, 242, 242' lying in the interior spaces of the supply tanks 90, 91, 92, 92' are moved in the longitudinal direction of the plunger rods, so as to force the contents of the supply tanks 90, 91, 92, 92' into the mixing device (FIGS. 1, 1A, 1B, 1C and 1D. The motor of the drive unit 102 for activating the hydraulic cylinders is controlled, i.e., turned on and off, by means of the actuation lever 115, so that the manufactured knifing filler can be removed on a stopping knife 120 in the respectively desired quantity, while the drive unit 250 for the mixing device 1 is simultaneously also turned on and off (FIGS. 1 and 2).

FIGS. 1A, 1B, 1C and 1D show additional spatial depictions of the device 100 on FIG. 1. Provided on the filler head 104 are tank receptacles for binder component A and hardener components B, B1, B2. Profiled sections can be provided inside the tank receptacles to ensure the stability of the supply tanks 90, 91, 92, 92'.

The device 100 shown on FIG. 1 encompasses a device 1 for mixing two components, specifically the binder component A and the hardener components B, B1, B2. The individual components A, B, B1, B2 are fed to this mixing device 1 via the supply channels 204, 205, 206, 206' of the filler head 104.

Figure 1C:
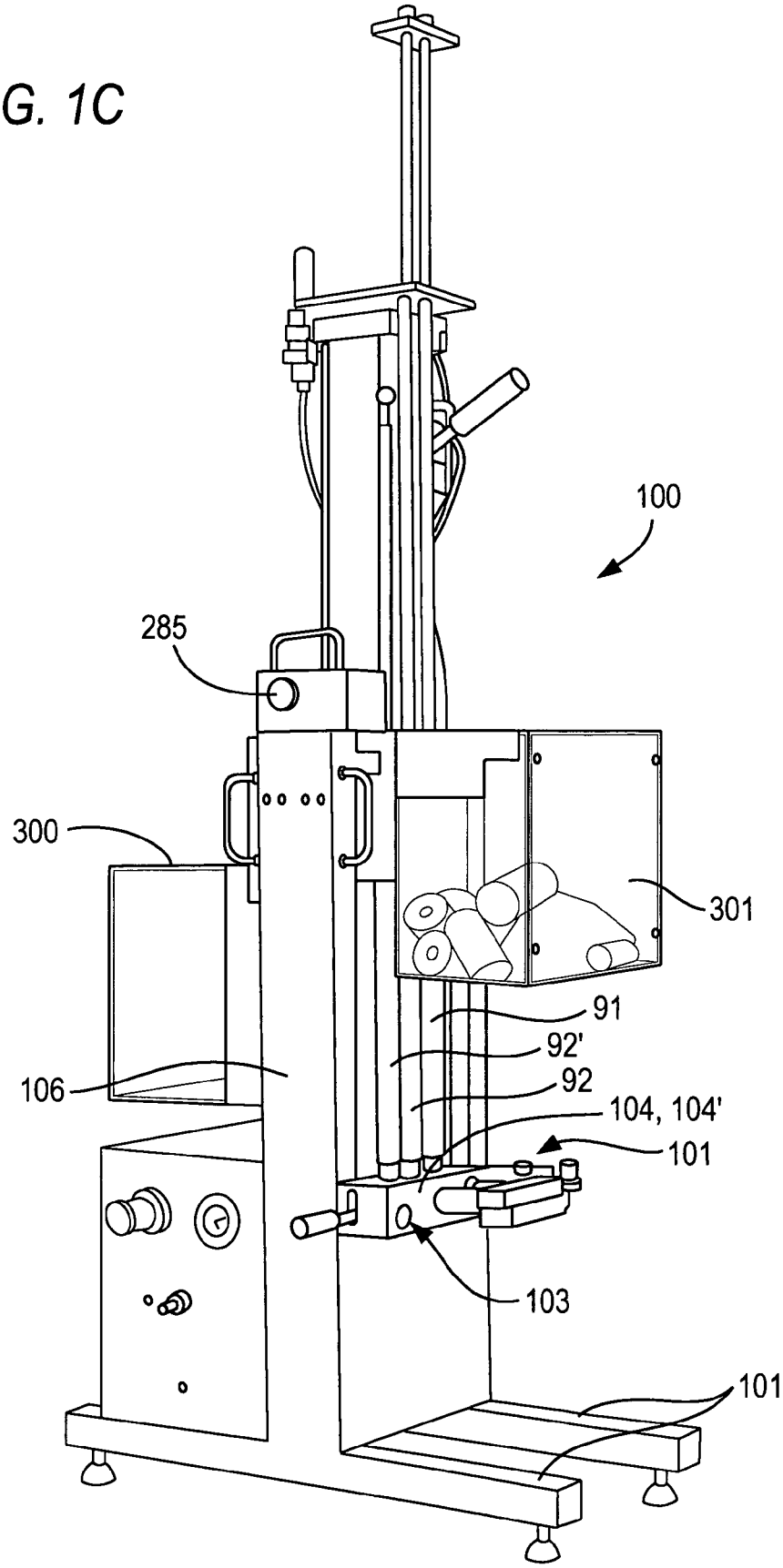
FIG. 1C is a diagrammatic view of the device with a supply tank for the binder component and three supply tanks for the hardener component.
Figure 2:
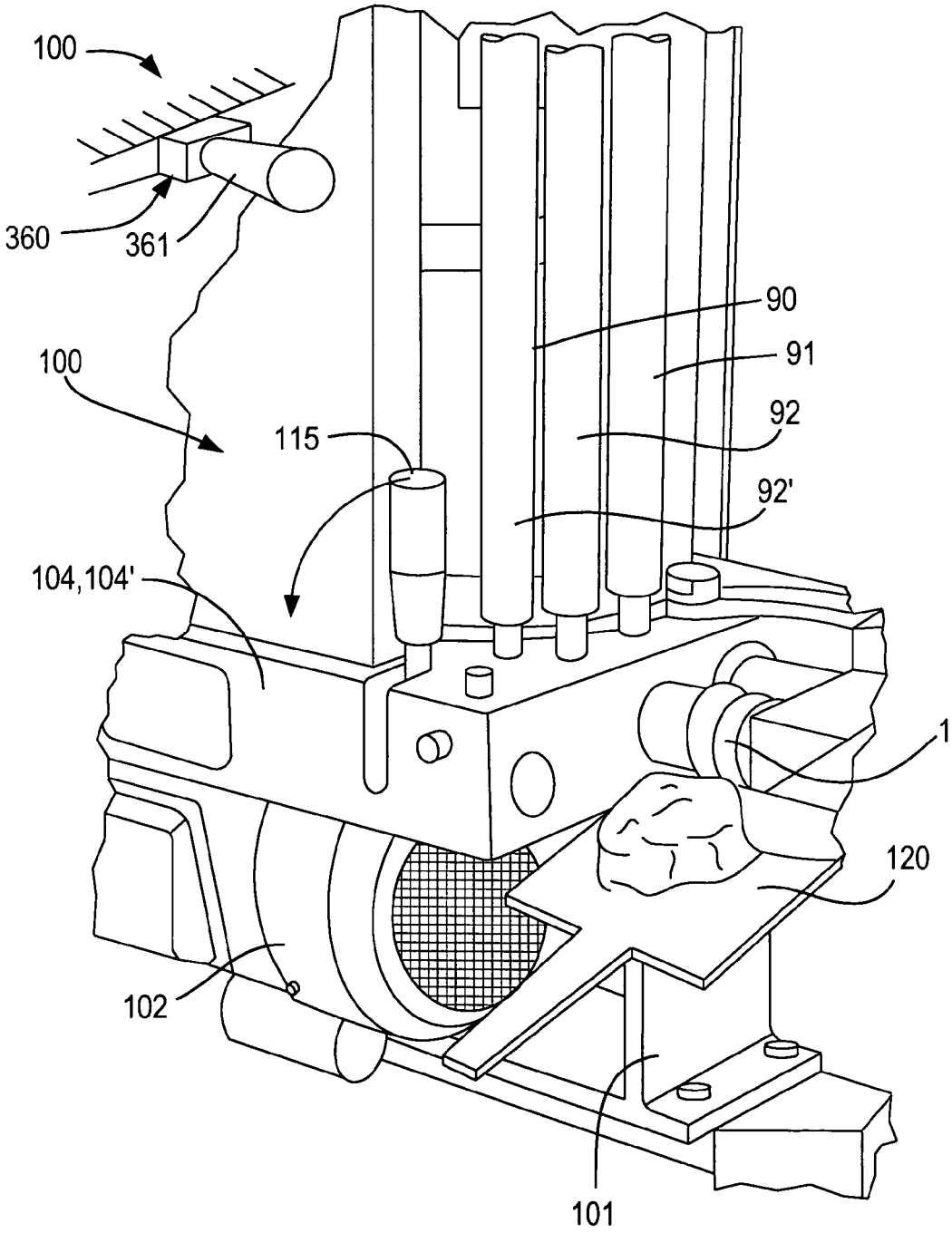
FIG. 2 is a diagrammatic view of a portion of the device with a supply tank for the binder component and three supply tanks for the hardener component.

In addition to the supply tank 90 for the binder component A, the device 100 on FIG. 1C and FIG. 2 has two supply tanks 91, 92 for hardener components B, B1, along with another supply tank 92' for another hardener component B2. This supply tank 92' is stably situated on the filler head 104 or support plate 104'. Similarly to the other supply tanks 91, 92, the content is forced out of the tank when starting up the device, and gets into the mixing device via the filler head 104, wherein the outlet opening of the supply tank 92' corresponds with a supply channel 206' in the filler head 104 or in the support plate 104' (FIGS. 3, 4, 5 and 6). The hardener component B2 is forced out of the supply tank 92' via the drive unit 270 by means of a hydraulic or motorized plunger rod 112' with a plunger plate 242' secured to the end, wherein the plunger rod 112' is designed as a toothed rack that functionally interacts with the third drive unit 270. In order to actuate the hydraulic cylinder or plunger rod 112' (FIGS. 7 and 8), the third drive unit 270 is arranged on the columnar brace 106 of the device 100 in a box-like container 285. The motorized drive units 102, 270 and motorized drive unit 250 for the mixing device 1 are combined in a program clock or controller 280 (FIG. 1C), specifically in such a way that, before the mixing process begins, i.e., before binder component A and hardener components B, B1 are supplied and the hydraulic cylinder or plunger rod are actuated for the supply tank 90 for binder component A and for the two supply tanks 91, 92 for hardener components B, B1, the drive unit 270 for the third supply tank 92' for hardener component B2 is made operational independently of all other functions, so that a first running of hardener component B2 takes place for about 1 second prior to the start of the actual mixing process, wherein, after the rotational motion of the rotor section 19 of the mixing device 1 has begun, the third drive unit 270 for the third supply tank 92' for hardener component B2 is operated with a last running of 1 second to supply additional hardener component B2, wherein, once the third supply tank 92' for hardener component B2 has been completely evacuated, a toothed rack driven by the third drive unit 270 arranged in a box-like container 285 on the cross brace 108 or the two braces 106 of the fixed base 101 reaches the lower region of the third supply tank 92' for hardener component B2. The toothed rack that extends even further and moves downward (not shown in the drawing) lifts the box-like container 285, which is hinged to one side of the cross brace 108, in such a way that the box-like container 285 is lifted about 2 mm, wherein this movement of the box-like container 285 activates an optical signaling device 290, and deactivates the entire setup of the device 100 to replace the empty third supply tank 92' for hardener component B2 with a full supply tank with hardener component B2.

The wall surface 235*c* of the molded part 235 of the collection tank 230 opposite the connecting pipe 231, 232, 232' exhibits a connecting pipe 234, in which the handle or clamping unit 103 of the device 100 engages the drive shaft of the drive unit 250 for the mixing device 1 in order to mount and center the collection tank 230.

Figure 11:
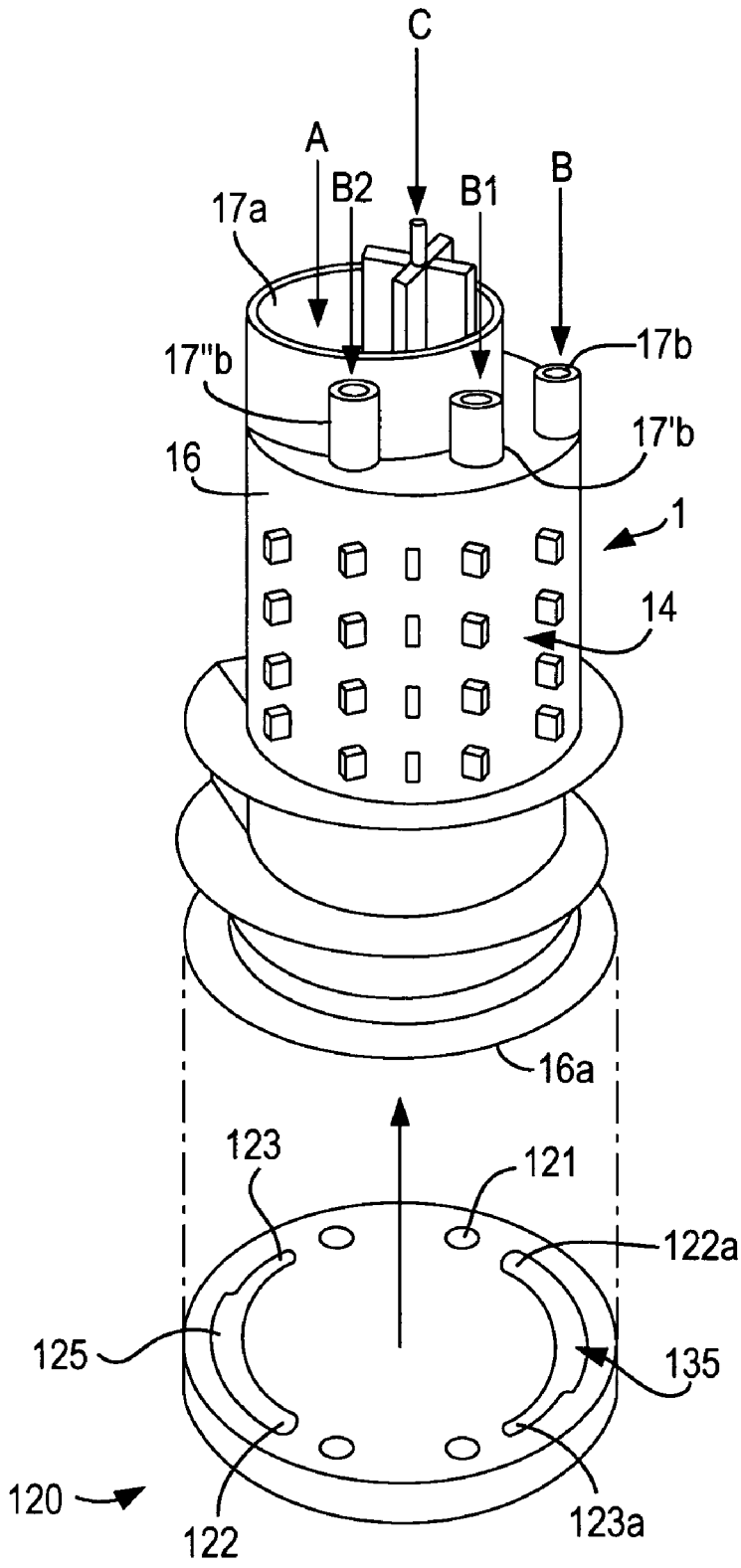
FIG. 11 is a diagrammatic view of the mixing device consisting of the stator section and rotor section, with controllable feed lines for a binder component and two hardener components from supply tanks connected with the mixing chamber, wherein the end of the stator section facing away from the feed lines for the components [exhibits] an annular mount detachably coupled with the stator section and rigidly coupled with the device.
Figure 12:
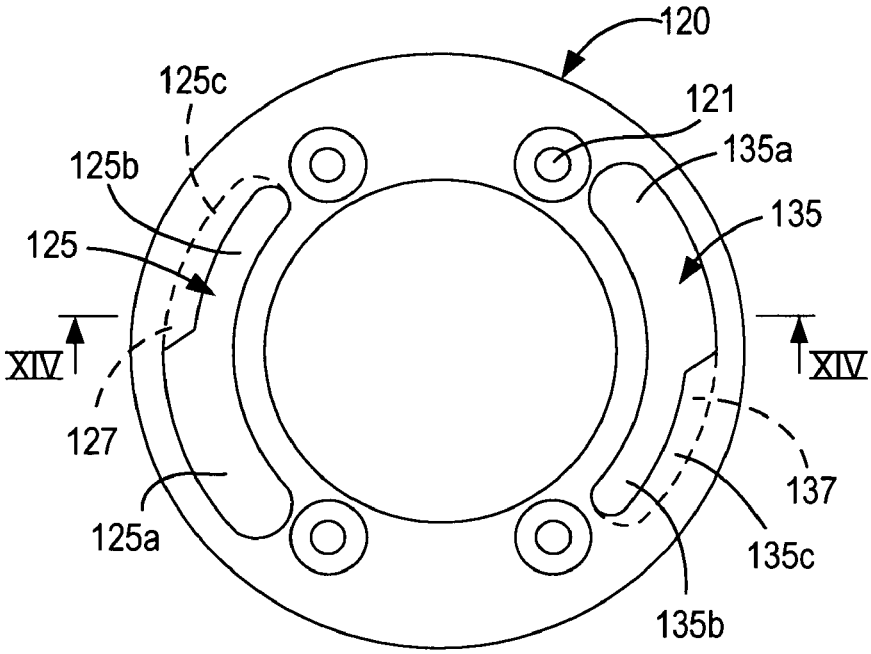
FIG. 12 is a magnified top view of the annular mount.
Figure 13:
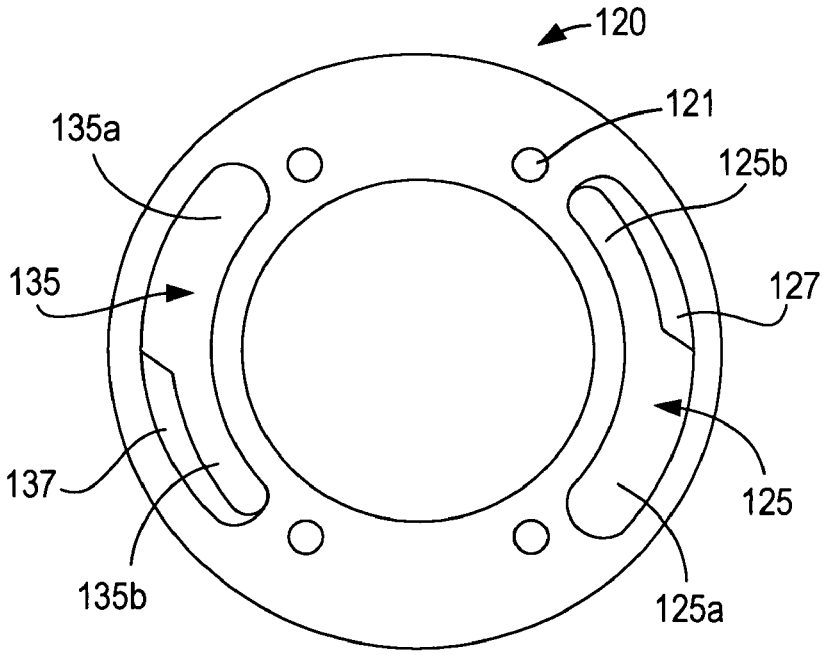
FIG. 13 is a magnified bottom view of the annular mount.

The mixing device 1 shown on FIG. 11 to 24 encompasses a stator section 16 and rotor section 19. The rotor section 19 is incorporated in the stator section 16, and mounted so that it can rotate therein. The drive for the rotor section 19 engages at C (FIGS. 11 and 17). In order to supply the mixing material and also the hardener component B2 for the first running and last running, the stator section 16 has inlet openings or inlet nozzles 17*a*, 17*b*, 17'*b*, 17"*b*, wherein binder component A is supplied through inlet opening 17*a*, and hardener components B, B1, B2 are supplied through inlet openings 17*b*, 17'*b*, 17"*b*. To better illustrate the supply of components, respective arrows are marked A, B, B1, B2. The rotor section 19 can pivot around a longitudinal axis 20, wherein the end of rotor section 19 is provided with projections 22, which co-rotate with the rotor section 19 and extend into the inlet opening 17*a*. This increases the ease of flow of the thixotropic binder component A, wherein multiple projections 22 are provided at the end of the rotor section 19.

The mixing device 1 is attached and held on the mount 103 of the fixed base 101 of the device 100 according to FIGS. 11, 12, 13, 14, 15 and 16 by means of an annular mount 120. To this end, the end 16*a* of the stator section 16 facing away from the inlet openings 17*a*, 17*b*, 17'*b* carries the annular mount 120, which exhibits attachment holes 121, and is detachably pivoted to the stator section 16 via a bayonet catch, wherein stops 122, 123; 122*a*, 123*a* limit the ability of the mixing device to rotate in such a way as to achieve a fit between the inlet opening 17*a* for binder component A and the guiding of binder component A, and simultaneously a fit between the inlet openings 17*b*, 17'*b*, 17"*b* for hardener components B, B1, B2 and the feed lines for the hardener components B, B1, B2.

This annular mount 120 exhibits two opposite, curved, slotted holes 125, 135, of which each hole 125, 135 has two guiding sections 125*a*, 125*b*, 135*a*, 135*b* with different widths, wherein the respectively wider guiding section 125*a*, 135*a* is designed for introducing one of two L-shaped guiding cam 140, 140' molded to the lower rotating edge 16*a* of the stator section 16, wherein the width of the wider guiding section 125*a*; 135*a* corresponds to the length of the free, angled leg 140*a*, 140'*a* of the guiding cam 125, 135, and of which the respectively narrower guiding section 125*b*, 135*b* exhibits a width that corresponds to the thickness of the leg 140*b*, 140'*b* of the L-shaped guiding cam 140, 140' that is molded to the lower rotating edge 16*a* of the stator section 16 and runs parallel to the longitudinal direction of the mixing device 1.

The respective outer wall area 125*c*, 135*c* of the narrower guiding section 125*b*, 135*b* exhibits web-like wall sections 125*d*, 135*d* accompanied by the formation of tongue-like edge areas 127, 137, thereby forming groove-like recesses with a depth roughly corresponding to the thickness of the angled leg 140*a*, 140'*a* of the L-shaped guiding cam 140, 140' (FIG. 11).

The annular mount 120 consists of a plastic or other suitable material, e.g., a metal.

The annular mount 120 is used as follows: The annular mount 120 is secured to the mount 103 of the fixed base 101 of the device 100 in such a way that the slotted holes 125, 135 face the mixing device 1 with their wider guiding sections 125*a*, 135*a* and their narrower guiding sections 125*b*, 135*b* (FIG. 11). After the annular mount 120 has been attached, the mixing device 1 is placed on the mount 120 in such a way that the L-shaped guiding cams 140, 140' of the mixing device 1 are passed through the wider guiding sections 125*a*, 135 of the slotted holes 125, 135 (FIG. 16). The mixing device 1 is then rotated around its longitudinal axis until the free legs 140*a*, 140' of the L-shaped guiding cams 140, 140' hit the ends of the narrower guiding sections 125*b*, 135*b* of the slotted holes 125, 135. In the process, the free legs 140*a*, 140'*a* of the L-shaped guiding cam 140, 140' reach under the tongue-like edge areas 127, 137 of the narrower guiding sections 125*b*, 135*b*, which run adjacent to the rotating edge of the annular mount 120 (FIG. 2). Therefore, the mixing device 1 is held via a bayonet catch to the annular mount 120, and hence to the mount 103 of the fixed base 101 of the device 100. When the mixing device 1 is turned counterclockwise, the bayonet catch is released, and the mixing device 1 can be removed from the device 100, so that a spent mixing device 1 can be replaced with a new mixing device. As a result of this approach to mounting the mixing device 1 to the device 100, after the mixing device 1 has been incorporated into the annular mount 120, the ability of the mixing device 1 to rotate is limited by the stops 122, 123, 122*a*, 123*a* at the ends of the slotted holes 125, 135 of the annular mount 120, 130 in such a way as to achieve a fit between the inlet opening 17*a* for binder component A and the feed line for binder component A, along with a fit between the inlet openings 17*b*, 17'*b*, 17"*b* for hardener components B, B1, B2 and the feed lines for the hardener components B, B1, B2 (FIG. 11).

The projections 22 at the end of the rotor section 19 impart kinetic energy to binder component A, so as to reversibly disrupt its thixotropy, so that binder component A can be mixed more uniformly with the two hardener components B and B1 upon entering a downstream mixing chamber 14. The mixing chamber 14 is designed like an annular gap between the rotor section 19 and stator section 16. The components A, B and B1 to be mixed are introduced into the mixing device 1 in such a way that they only combine after inside the mixing chamber 14 once first runnings followed by last runnings of hardener component B2 have already been fed to the mixing chamber 14. As a result, all residual mixing material stays in the mixing device upon completion of the mixing process and separation of the mixing device 1 from a corresponding fixed base. The latter is designed as a disposable part, which is discarded after use and replaced by a corresponding new part. The hardener components B, B1, B2 are fed via inlet openings 17*b*, 17'*b*, 17"*b* to the mixing chamber 14, in which the hardener components are mixed with the binder component A. In this case, the components A, B and B1 are added in the following sequence: Before the actual mixing process begins, first runnings of hardener component B2 is first fed from the supply tank 92' to the mixing device 1 for about one second, which does not yet contain any binder component A and any other hardener components. After the rotor section 19 starts to rotate, last runnings of the hardener component B2 ensues for another second, while the required quantities of binder component A and hardener components B and B1 are simultaneously fed from the supply tanks 90, 91, 92. Hardener component B2 is only supplied during first and last running.

Figure 6:
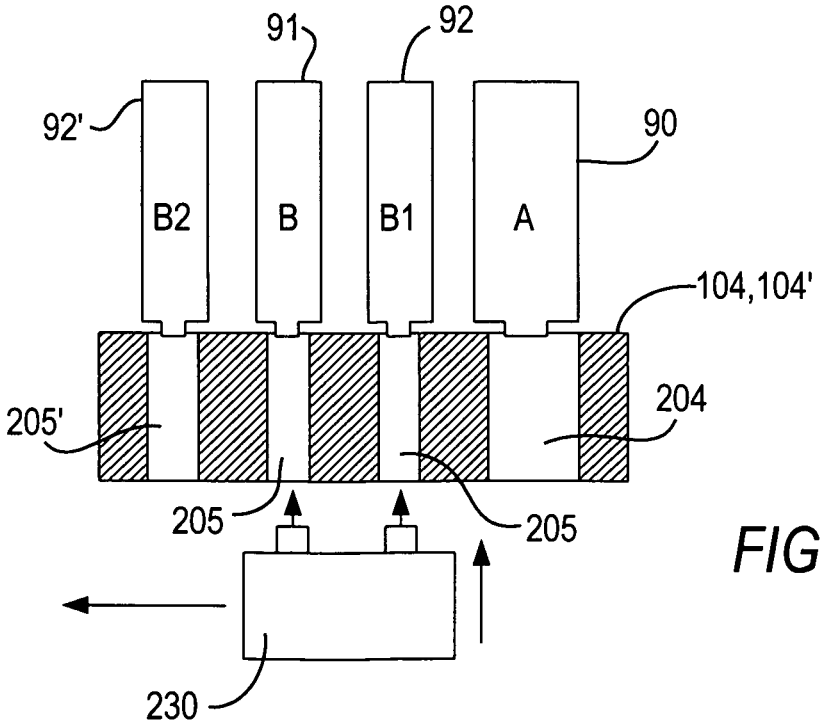
FIG. 6 is a schematic, partially cut view of the filler head with mounted supply tanks for the binder component and the two hardener components, with the collection tank allocated to the filler head.

A small quantity of hardener component B is then fed to the mixing chamber. At the same time, the binder component A and hardener component B1 are supplied, so that the binder component A entering the mixing chamber encounters the hardener component B or B2 already located in the mixing chamber, and mixes with the latter already. As a result of this approach, the binder component A flowing into the mixing chamber encounters the already present hardener component B or B2, and mixes with the latter, so that no portion of the binder component that has no hardener component can exit. It is here especially advantageous that hardener component B2 from the supply tank 92' has already been provided in the mixing chamber 14 via the first running, so that introduced binder component A encounters the hardener component B2 when flowing into the mixing chamber 14. Therefore, binder component always exits the mixing chamber mixed with the hardener component, so that the initially exiting mixture also contains hardener components, and can be immediately processed. Hardener component is subsequently fed to the mixing chamber 14 before the binder component flows into the mixing chamber. This first running of hardener component is achieved via control engineering, in that the metering devices 90, 91, 92, 92' for the hardener components and binder component are controlled accordingly (FIG. 6). In addition, the stator section 16 of the mixing device 1 can also exhibit just one feed line for the hardener component. In this case, a small quantity of hardener component B2 is first supplied via the controller in the form of first and last runnings, after which a small quantity of hardener components is fed into the mixing chamber 14, whereupon the binder component is supplied, specifically together with additional hardener components. Hardener component is only taken from the supply tank 92' for first and last running, so that a very small quantity of hardener component is present in the mixing chamber 14 already before the binder component is supplied, as a result of which binder components entering the mixing chamber 14 already encounter the hardener component introduced during the first running and, in order to provide a smooth transition, a small quantity of hardener is additionally supplied, followed by the continued introduction of hardener components and binder components. Instead of removing hardener components from two supply tanks, it is also possible to remove hardener component from just one of the two supply tanks for the hardener component for purposes of first and last running. However, it is more advantageous to provide two supply tanks for the hardener components and a separate supply tank with hardener component for first and last running.

Preferably upstream metering devices are used to continuously convey the components to be mixed through the mixing chamber 14 to a discharge opening 21 arranged at the stator section 16, which is arranged in the direction of flow behind the inlet openings 17*a*, 17*b* and 17'*b* and after the mixing chamber 14. Several first mixing teeth 23 are arranged at the stator section 16, which extend radially inward into the mixing chamber 14, while second mixing teeth 24 are arranged at the rotor section 19, which extend radially outward into the mixing chamber 14.

Hence, a rotational movement of the rotor section 19 in the stator section 16 moves the mixing teeth 23, 24 against each other, mixing together the two components A, B and B1. If a first running of the hardener component has already taken place, and a portion of the ensuing binder component A has been mixed with the hardener component B, and the two other components A and B have been fed to the mixing chamber [translator's note: incomplete German sentence]. The binder component A and hardener components B, B1 are then mixed together in the mixing chamber 14. These two components A and B, B1 are introduced into the mixing chamber at a prescribed ratio until such time as the respectively desired quantity of mixing material is achieved. The first mixing teeth 23 are arranged on a first mixing toot plane 10, and the second mixing teeth 24 are arranged on a second mixing tooth plane 11. A total of five first mixing tooth planes 10 and four second mixing tooth planes 11 are provided, alternately nested in an axial direction along the longitudinal axis 20. The rotational movement of the rotor section 19 causes the second mixing teeth 24 to radially rotate in the gaps of the first mixing teeth 23, which molded motionlessly to the stator section 16. This yields a shearing or leaving motion between the mixing teeth 23 and 24, so that the mixing material becomes optimally mixed.

The two components A, B and/or B1 are preliminarily mixed by means of two larger second mixing teeth 24 situated at the front end of the rotor section 19, so that these components are preliminarily mixed by these mixing tooth plane. The larger second mixing teeth 24 arranged on the end are arranged in fours on the periphery of the rotor section 19, and each pass into the projections 22, which are also present in fours. The open end of the stator section 16 exhibits a reception opening, in which a cylindrical bearing section 27 molded onto the rotor section 19 causes the rotor section 19 to be held in the stator section 16. This provides a radial mounting of the rotor section 19 in the stator section 16. The diameter fit of the cylindrical bearing section 27 on the rotor section 19 is dimensioned in terms of diameter in such a way as to produce a corresponding sliding bearing arrangement.

Figure 20:
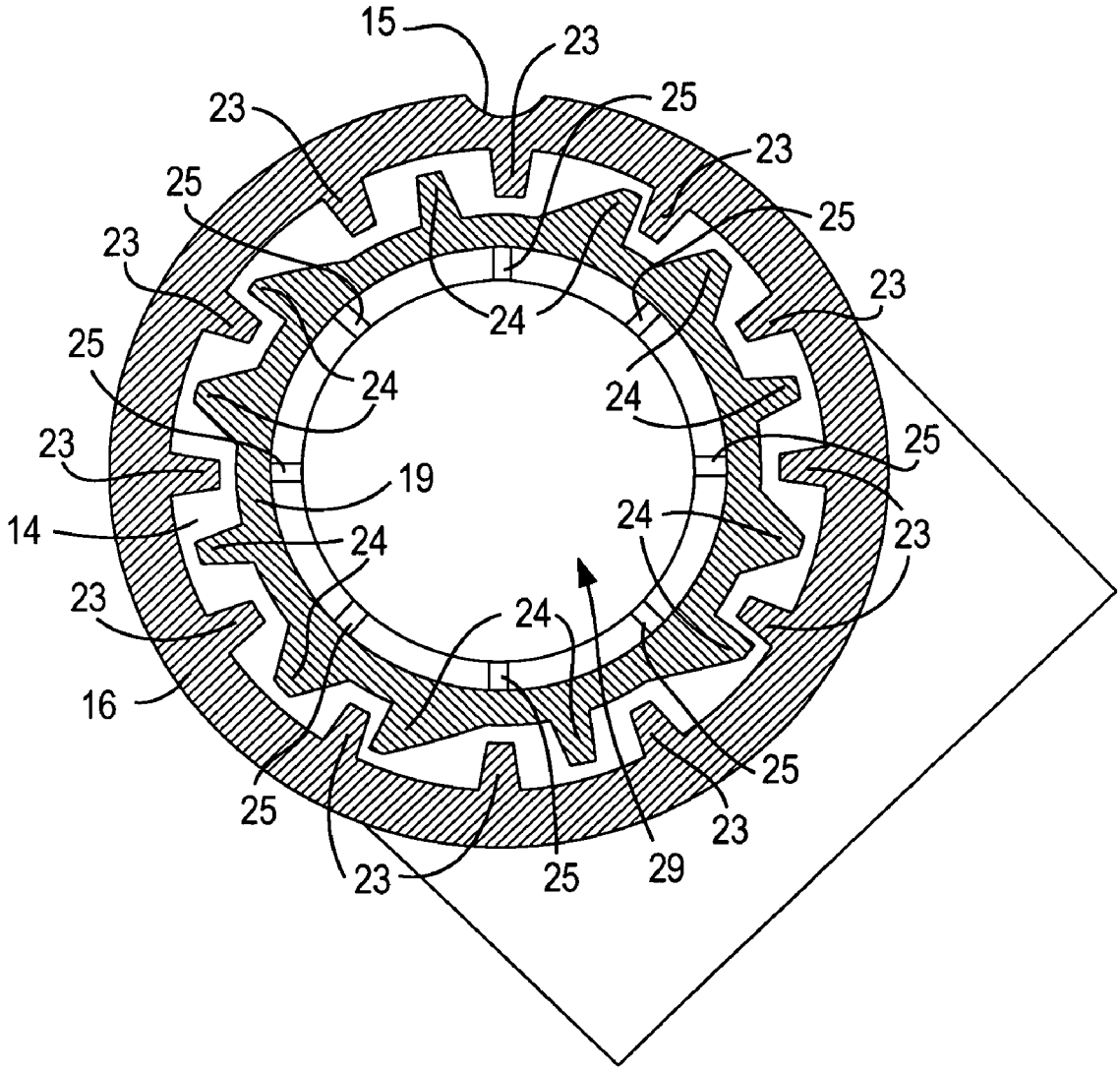
FIG. 20 is a cross section through the mixing device with cut stator section as well as cut rotor section.

FIG. 20 shows a cross section of the mixing device 1, wherein both the stator section 16 and rotor section 19 are depicted in cross section. In particular the arrangement of mixing teeth 23 and 24 is illustrated herein, wherein the second mixing teeth 24 are formed on the rotor section 19 in such a way that, with respect to the manufacture of the rotor section 19 via injection molding, only a single plane of osculation is sufficient for the use an injection molding tool. As also evident, the mixing teeth 23, 24 are molded on the stator section 16 and rotor section 19 in a materially uniform manner, so that the mixing device 1 consists only of these two components. The rotor section 19 exhibits an inner area in the form of a hollow recess 29. Latching ribs 25 run radially inward into the recess 29, wherein a total of eight latching ribs 25 are arranged on the periphery. The stator section 16 encompasses a crescent-shaped latching contour 15, which is provided on the outer periphery.

Figure 21:
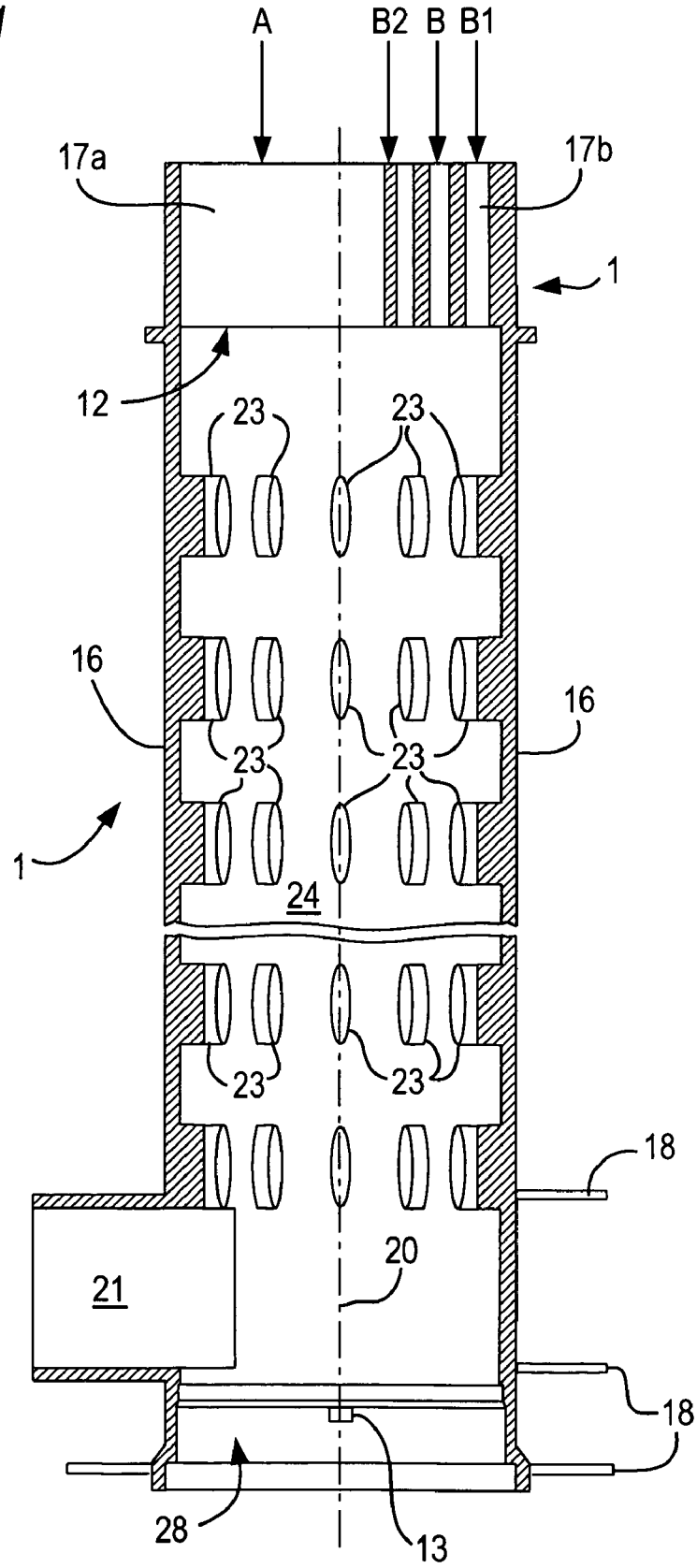
FIG. 21 is a longitudinal section through the stator section.

FIG. 21 illustrates a cross section of the stator section 16, which is shown cut along the longitudinal axis 20. As a result, the arrangements of inlet openings 17*a*, 17*b*, 17'*b* are shown in section, and empty directly into the mixing chamber 14. The first mixing teeth 23 are arranged on the total of five planes on the interior in the wall of the stator section 16, wherein a total of twelve first mixing teeth 23 are distributed over the periphery on one respective mixing tooth plane. Provided on the end of the mixing chamber 14 lying opposite the inlet openings 17*a*, 17*b* and 17'*b* is a discharge opening 21, which removes the mixing material radially outward from the mixing chamber 14 (FIG. 5). Situated on the outer periphery of the stator section 16 are plate-shaped moldings 18, wherein a total of three plate-shaped moldings 18 are provided on the height of the discharge opening 21 and on the end of the stator section 16. The inlet opening 17*a* or 17*b* passes over into the mixing chamber 14 at the height of a support bearing surface 12, wherein the support bearing surface 12 forms an axial bearing of the rotor section 19 (not shown here). The back end of the stator section 16 opposite the inlet openings 17*a*, 17*b*, 17'*b*, 17"*b* is open at the end, so that the rotor section 19 can be inserted through this opening into the stator section 16. In the area of the opening, the stator section 16 exhibits a hollow space 28 designed as a section, so as to accommodate the mixing material moving into this area. In order to allow the mixing material to exit if needed, outlet openings 13 are incorporated in the wall, arranged in duplicate around the periphery.

Figure 22:
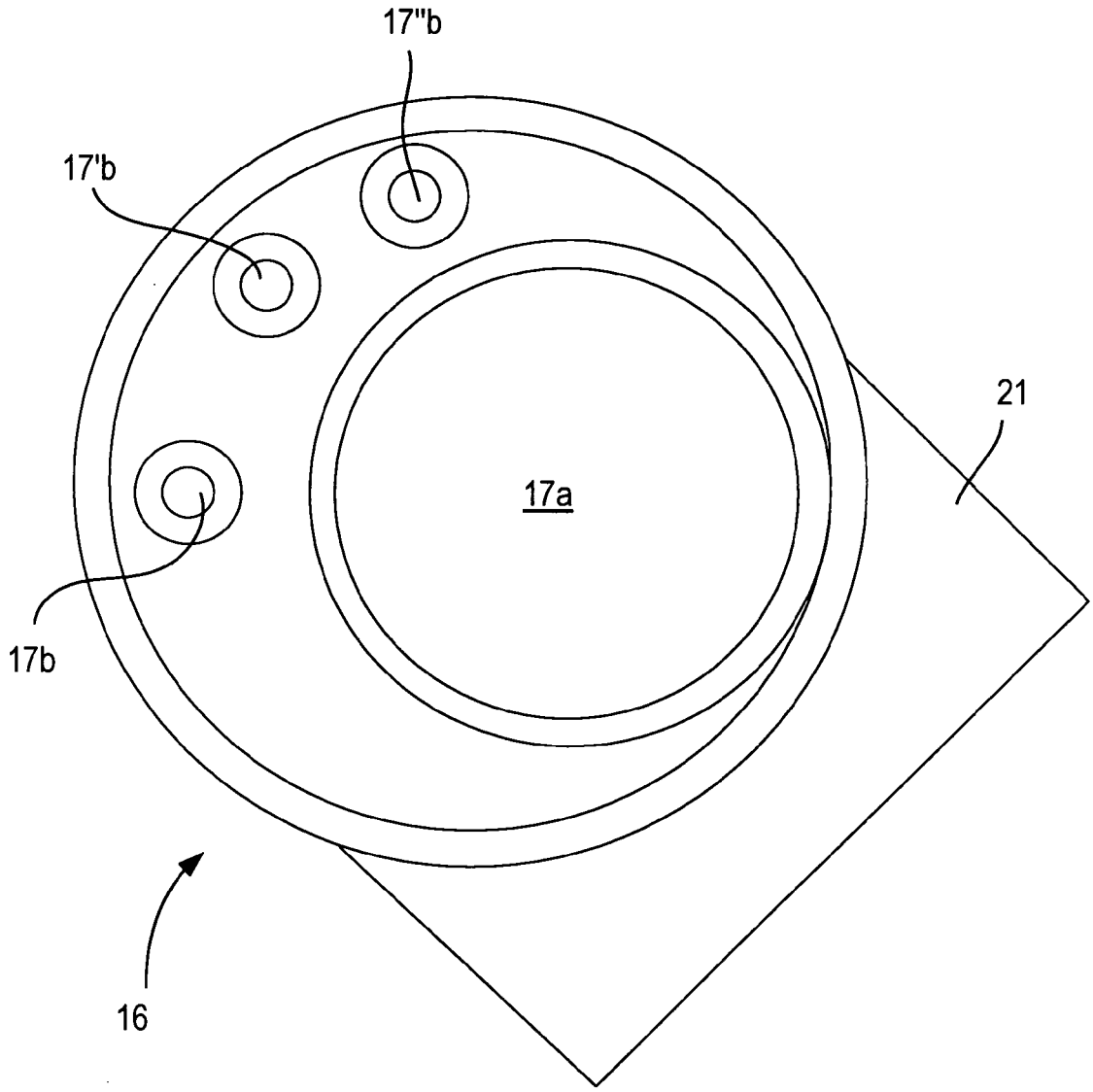
FIG. 22 is a top view of the stator section, as seen on the end from the direction of the inlet openings.

FIG. 22 shows a top view of the stator section 16, which reveals in particular the arrangement of inlet openings 17*a*, 17*b*, 17'*b*. The inlet opening 17*a* is eccentrically designed, and exhibits a circular cross section. Provided next to the inlet opening 17*a* are two inlet openings 17*b*, 17'*b* to enable a redundant supply of the hardener component into the mixing chamber 14. The inlet openings 17*b*, 17'*b*, 17"*b* are here spaced apart relative to each other, and are supplied by feed lines and metering devices 91, 92, which are also spaced apart from each other. Also depicted is the positioning of the discharge opening 21, which laterally conveys the mixing material out of the stator section 16.

Figure 23:
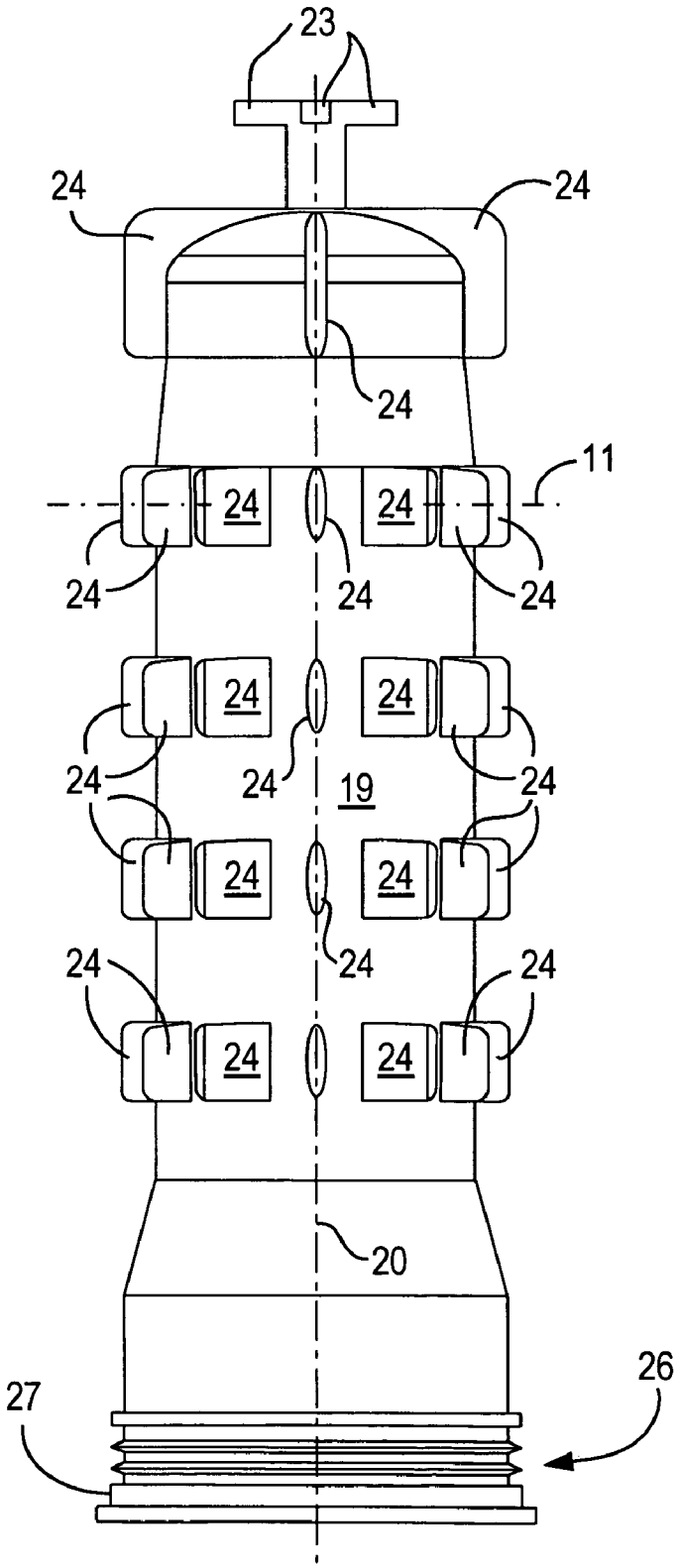
FIG. 23 is a side view of the rotor section of the mixing device.

FIG. 23 shows the rotor section 19, wherein in particular the second mixing teeth 24 are depicted in terms of their distribution around the periphery of the rotor section 19. A total of twelve mixing teeth are provided on one mixing tooth plane 11, so that there are a total of 48 mixing teeth arranged on a total of four mixing tooth plane 11 on the rotor section 19. In addition, the upper portion of the rotor section 19 has for additional mixing teeth 24 for pre-mixing the mixing material. These pass over into projections 22, which are also arranged in fours on a type of elongation of the rotor section 19.

Figure 24:
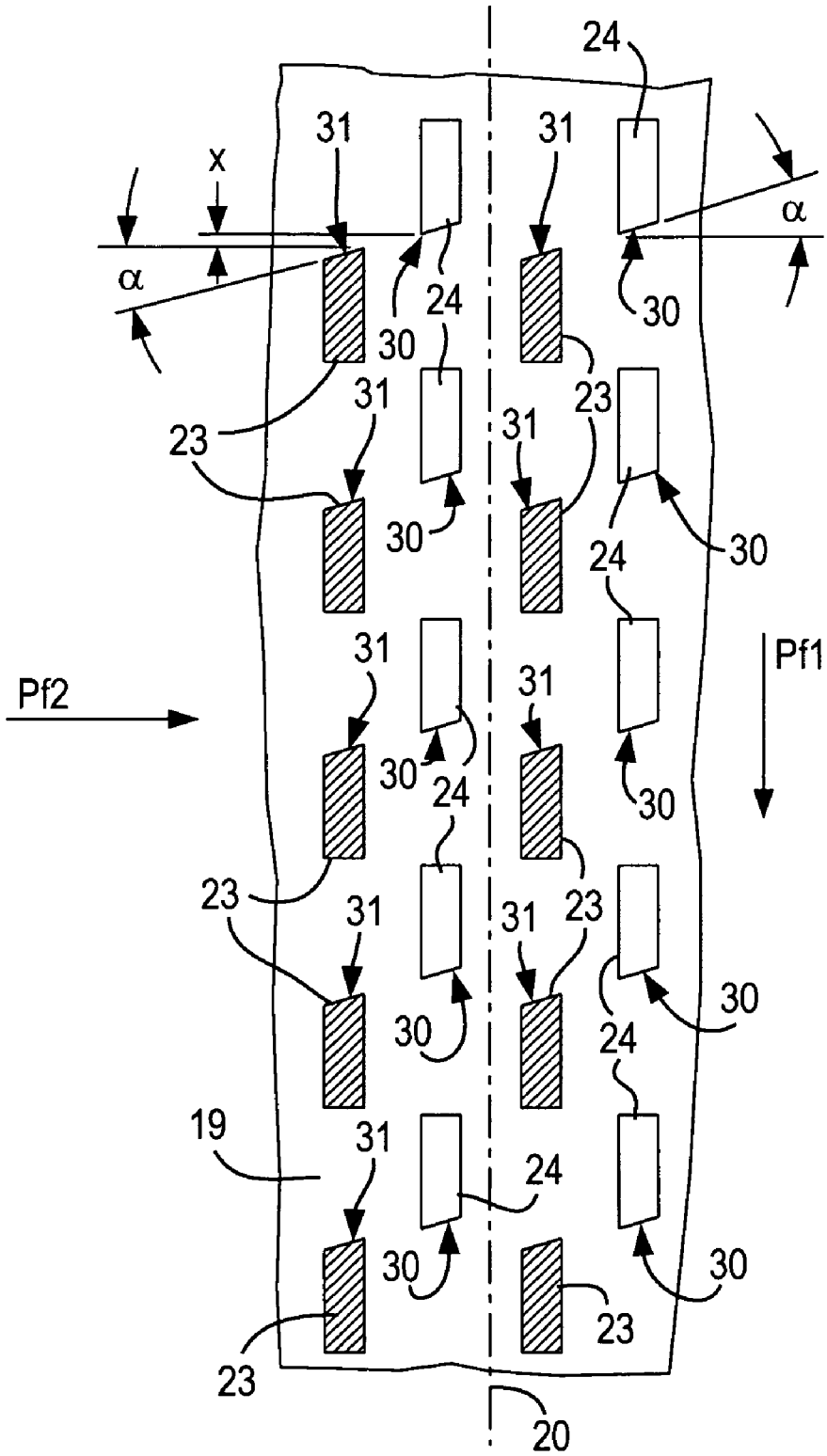
FIG. 24 is a partial cross section through the rotor section and stator section along an annularly progressing mixing zone inside the mixing chamber, wherein the teeth of the stator section are shown hatched, and the teeth of the rotor section are shown not hatched.

FIG. 24 illustrates a partial cross section through the mixing device 1 along the annularly rotating mixing zone, wherein the mixing teeth 23 of the stator section 16 are hatched, and the mixing teeth 24 of the rotor section 19 are not hatched. The mixing teeth 23 and 24 of the individual mixing tooth planes are spaced apart relative to each other in such a way that the teeth exhibit gashes between them. The mixing teeth 23, 24 exhibit gaps between the individual mixing tooth planes, through which the mixing teeth lying opposite the respective gap of the other side pass during the rotational motion. The continuous supply of components A, B into the mixing chamber 14 divides the mixing material stream, i.e., the mixing material stream flows on the one respective side of the tooth 23, 24 in question, while the other portion flows on the other side of the tooth 23, 24 in question. Since this separation takes place in several stages corresponding to the number of tiers or mixing tooth planes, the mixing material is intensively mixed.

The mixing teeth 23 have front lateral surfaces 31, which lie opposite the front lateral surfaces 30 molded onto the second mixing teeth 24. This allows sliding to take place during contact between the mixing teeth 23 and 24, without material being removed on the mixing teeth. This can happen in particular in cases where the rotor section 19 is offset relative to the stator section 16 by amount x, so that the mixing teeth 23, 24 hit each other. The front lateral surfaces 30, 31 are beveled at an angle $\alpha$, wherein the angle $\alpha$ preferably measures 15°.

The process to be followed in operating the device 100 involves manually placing the plunger rods 110, 111, 112, 112' with the plunger plates 240, 241, 242, 242' inside the open supply tanks 90, 91, 92 and, as soon as the plunger plates come to rest below the opening edges of the supply tanks 90, 91, 92, 92', the drive unit 270 for the hydraulics used in actuating the plunger rod 245' for the supply tank 92' for hardener component B2 is made operational, so that the first running for hardener component B2 can be initiated. Once the first running of hardener component B2 has been initiated, the motor 102 for the hydraulics used to actuate the plunger rods 110, 111, 112 for the supply tanks 90, 91, 91 for binder component A and hardener component B, B1 is made operational, wherein the last running for the hardener component is simultaneously initiated; only then are the individual mixing processes executed. This measure prevents injuries that happen when fingers on the hand of an operator come to rest in the area of the opening edge, in particular of the supply tank 90 for binder component A and get jammed by the plunger plate moving in the tank direction under a relatively high pressure.

The mixing device 1 with its connecting pipe-like introduction openings 17*a*, 17*b*, 17'*b*, 17"*b* is inserted into the outlet openings 201, 202, 203, 203' of the filler head 104 when the device 1 is put into operation (FIGS. 1E and 11). The mount 103 is here opened, the mixing device 1 with its introduction openings 17*a*, 17*b*, 17'*b*, 17"*b* is inserted into the outlet openings 201, 202, 203, 203' of the filler head 104, and the mount 103 is closed, wherein a connection is simultaneously established between the rotor section 19 and the drive motor 250 provided on the mount 103 (FIG. 1E).

In order to facilitate supply tank exchange and equalize the fill levels in the supply tanks, since the latter vary between binder component A and hardener components B, B1, the collection tank 230 is provided to eliminate overfilling of the supply tanks 91, 92 for hardener component B, B1, and placed in the device 100 in place of the mixing device 1 when starting to tap components A, B, B1 from their supply tanks 90, 91, 91.

The molded part 235 of the collection tank 230 consists of a plastic or suitable material.

The collection tank 230 is used as follows:

After a new supply tank 90 for binder component A and new supply tanks 91, 92 for hardener components B, B1 have been incorporated into the device 100 (FIG. 6), the collection tank 230 is placed in the mount 103 (FIG. 1E), wherein its connecting pipes 231, 232 are inserted into the outlet openings 202, 203 of the supply channels 205, 206 of the filler head 104, via which the binder components B, B1 are supplied (FIGS. 3 and 6). After the collection tank 230 has been placed in the filler head 104, a handle 260 joined with the plunger rods 110, 111, 112 of the supply tanks 90, 91, 92 for binder component A and hardener component B, B1 is pulled as forcefully as possible in the direction of arrow X, i.e., toward the fixed base 101 of the device 100 (FIG. 1), so that the plunger rods 110, 111, 112 are moved in the direction of arrow x1, x2, x3 (FIG. 7) until the plate-shaped plungers 240, 241, 242 act on the surfaces 0B, 0B1, 0B2 of the components A, B, B1 of supply tanks 90, 91, 92. The tensile force exerted on the handle 260 is then increased, forcing the contents of the supply tank 91, 92 for hardener components B, B1 to be pushed in the direction of arrow x4, x5 to the point where the overflow in the two supply tanks 91, 92 for hardener components B, B1 is forced out of the supply tanks 91, 92, and into the collection tank 230 (FIG. 8). This equalizes the fill levels in the three supply tanks 90, 91, 92, i.e., the fill levels in the supply tanks 91, 92 then have reached the fill level in supply tank 90, since the higher viscosity of binder component A relative to the viscosity of hardener component B, B1 prevents the binder component A from being pressed out of its supply tank 90 as the quantity of hardener component B for the inspection is forced out of its supply tanks 91, 92.

The fill levels in all three supply tanks 90, 91, 92 are first equalized (FIG. 8). Then, the collection tank 230 filled with the overflow quantity of hardener component B, B1 is detached from the filler head 104 and disposed (FIG. 8). After the collection tank 230 has been detached from the filler head 104, the mixing device 1 is secured thereto by inserting the connecting pipe-like inlet openings 17*a*, 17*b*, 17'*b* of the mixing device 1 into the outlet openings 201, 202, 203 of the supply channels 204, 205, 206 in the filler head 104 (FIG. 7). The arrangement of outlet openings 202, 203 for the hardener component B, B1 in the filler head 104 and arrangement of connecting pipe-like inlet openings 17*b*, 17'*b* of the mixing device as well as that of the connecting pipes 231, 232 of the collection tank 230 is such that both the connecting pipe-like inlet openings 17*b*, 17'*b* of the mixing device 1 and the connecting pipes 231, 231 of the collection tank 230 can be inserted into the outlet openings 202, 203 for the hardener component B, B1 in the filler head 104. In addition, the outlet opening 201 for the binder component A is arranged in the filler head 104 in such a way that the connecting pipe-like inlet opening 17*a* of the mixing device 1 for binder component A can correspond with the outlet opening 201 for binder component A in the filler head 104 (FIG. 3).

Using the device 100 according to the invention with a mixing device 1 and a collection tank 230 gives rise to ready-to-use knifing filler for spackling the surfaces, for example, of motor vehicle bodies by mixing one binder component A with hardener components B, B1, B2 to form a pasty or liquid mixing material in such a way that, before starting to tap a mixed quantity of binder component A and hardener component B, B1, in order to equalize the surface height of the binder component A in its supply tank 90 and hardener components B, B1 in their two supply tanks 91, 92, the fill level of the hardener components B, B1 in the two supply tanks 91, 92 is set higher relative to the fill height of the binder component A in the supply tank 90, whereupon the plunger rods 110, 111, 112 that are accommodated in the interior spaces 90*a*, 91*a*, 92*a* of supply tanks 90, 91, 92 and carry plate-shaped plungers 240, 241, 242 at their ends are manually actuated to move them against the contents of the tanks while simultaneously acting on the binder component A in the supply tank 90 and hardener components B, B1 in the supply tank 91, 92, and the overfilled quantity of hardener components B, B1 is forced out of the supply tanks 91, 92 into the collection tank 230 incorporated in the device 1 until identical fill levels have been achieved for binder component A and hardener components B, B1, whereupon the collection tank 230 is replaced with the mixing device, and all plunger rods 110, 111, 112 are then actuated via motorized or hydraulic power so as to force the quantities of binder component A and hardener components B, B1 required for generating the mixture out of supply tanks 90, 91, 92 into the mixing device 1 in order to mix components A, B, B1, wherein the procedural sequence includes or can include the step of removing hardener component B2 from another supply tank 92' before the actual mixing process begins, and feed it to the mixing chamber 14 of the mixing device 1 as a first running and last running.

The supporting frame of the device exhibits an openable, transparent protective cover 200 for covering the supply tanks 90, 91, 92, 92', wherein a protective switch that interacts with the protective cover 200 and device 100 is provided, and deactivates the device if the protective cover is open, wherein the latter can consist of a clear plastic or other suitable material, and is designed as a door (FIG. 1A).

Figure 1D:
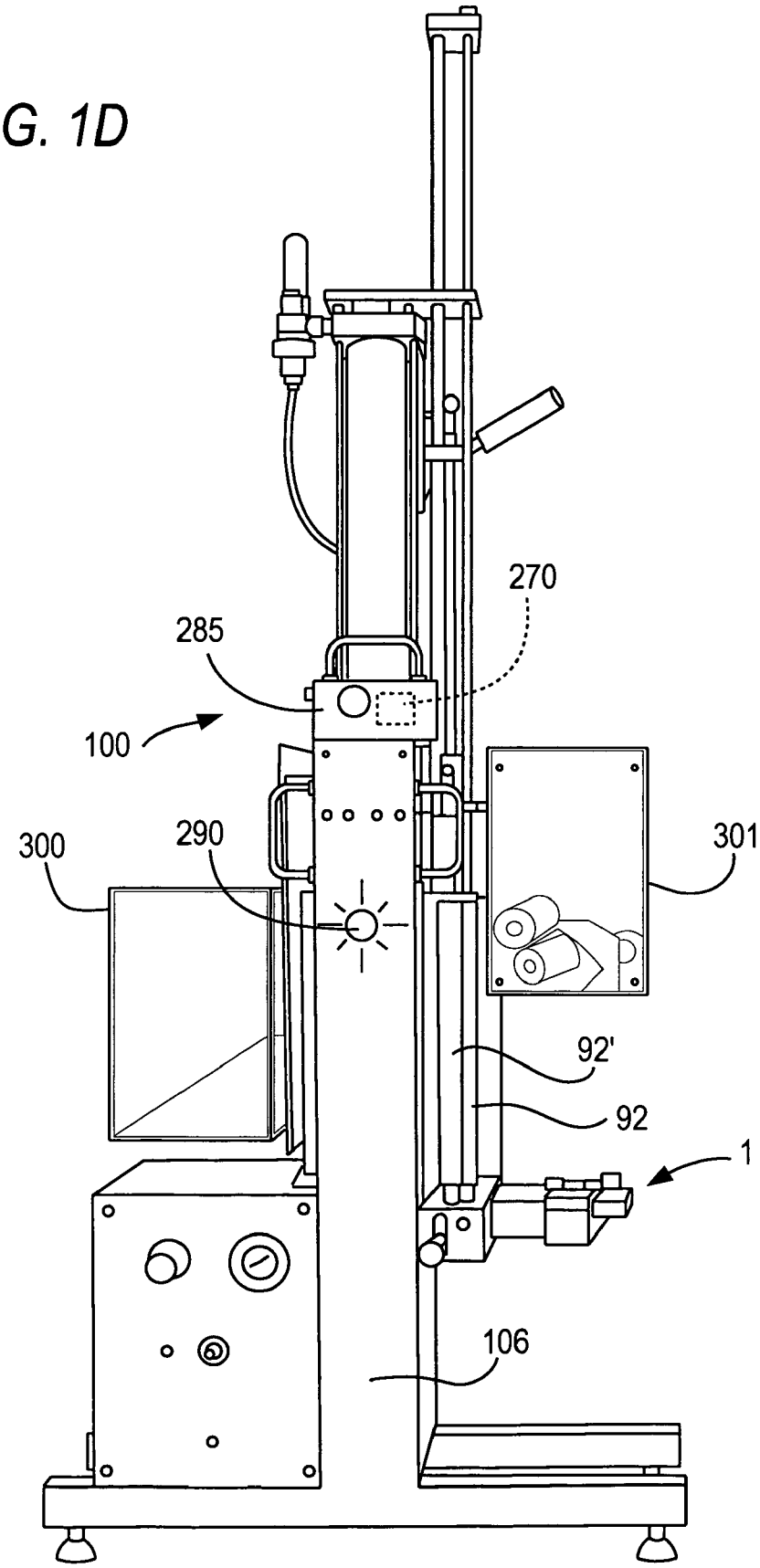
FIG. 1D is a side view of the device according to FIG. 1C.
Figure 1E:
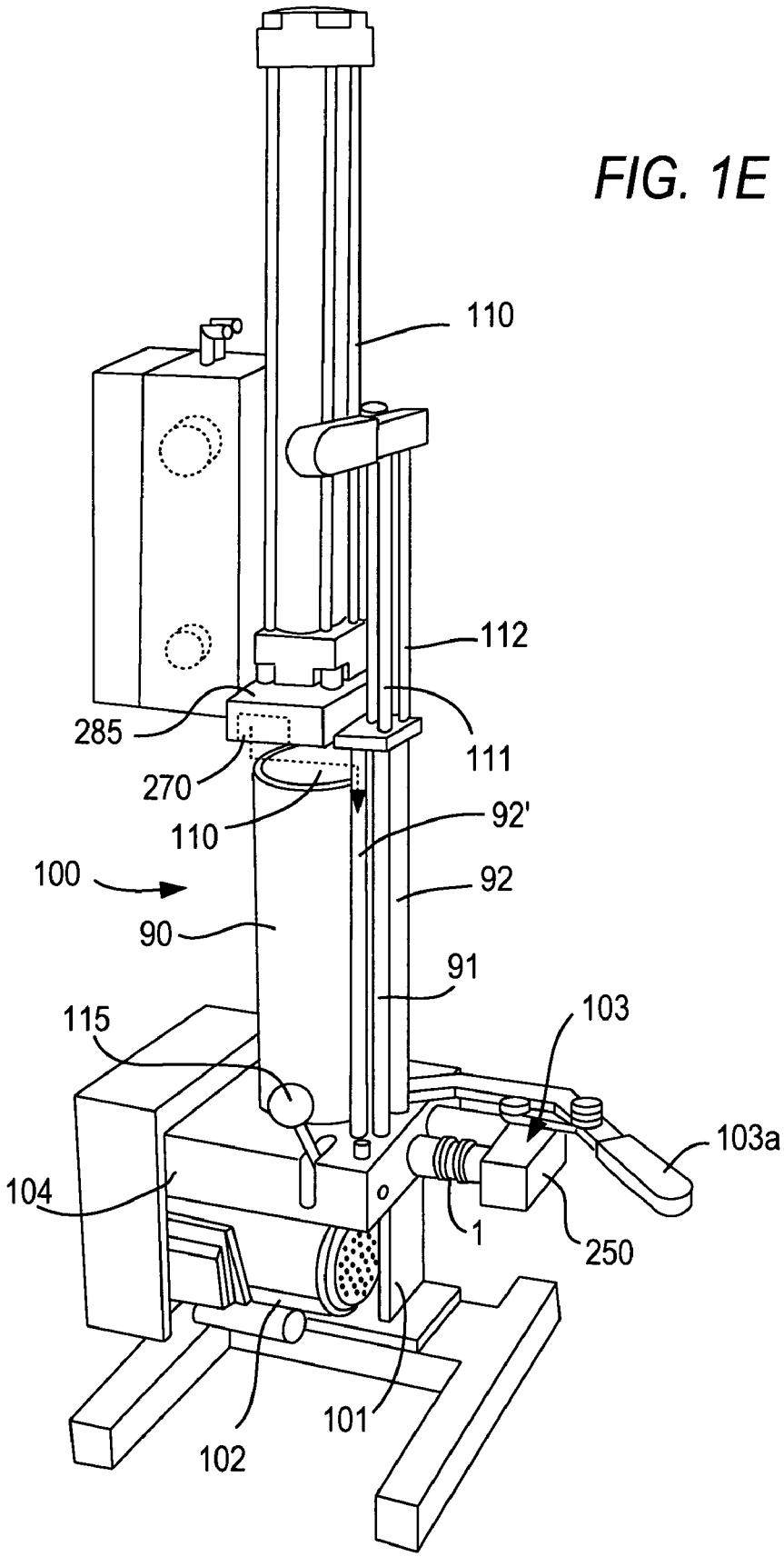
FIG. 1E is a diagrammatic view of the device with three supply tanks for the hardener component.
Figure 1F:
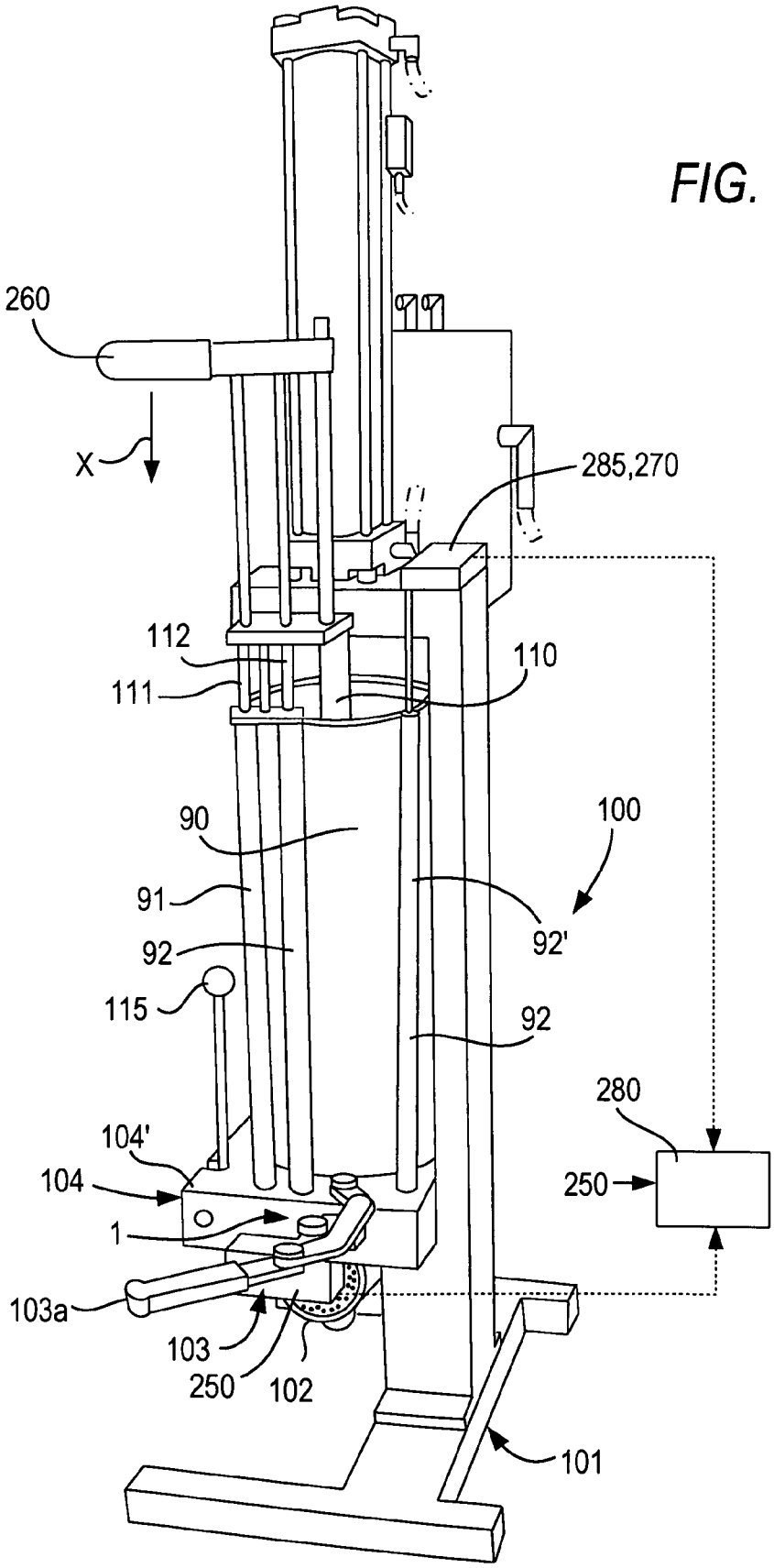
FIG. 1F is another diagrammatic view of the device.

In addition, the supporting frame of the device 100 has receiving tanks 300, 301 front and/or back for holding spent and new mixing devices 1 (FIGS. 1C and 1D).

In addition to the optical signaling device 290, the supporting frame of the device 100 can visually exhibit another optical signaling device 350 connected with the power source, such as a signaling lamp 351 that emits a white light or color light and/or an acoustic signaling device 360, such as a signal horn or siren 361, wherein both signaling devices 350, 360 are activated during startup of the device 100 for a prescribed period, most preferably for two or three minutes, by lighting up and/or emitting a signal. The signaling device 360 can be activated even given an empty indication for the supply tank 92' for hardener component B2 (FIG. 1).

While specific embodiments of the invention have been described in detail to illustrate the inventive principles, it will be understood that the invention may be embodied otherwise without departing from such principles.

I claim:

1. A device (100) for manufacturing ready-to-use knifing filler for spackling surfaces, in particular of motor vehicle bodies, by mixing at least two components, in particular a binder component (A) and a hardener component (B), by means of a mixing device (1) consisting of a hollow cylindrical stator section (16) and a rotor section (19) accommodated therein so that it can rotate concentrically around a longitudinal axis, and an annular gap forming the mixing chamber (14) formed between the rotor section (19) and stator section (16), to a pasty or fluid mixing material, wherein the mixing device (1) is provided with at least one inlet nozzle (17*a*) for supplying the binder component (A) and at least one inlet opening (17*b*, 17'*b*, 17"*b*) for supplying the hardener component (B), as well as with a discharge opening (21) for discharging the mixing material, wherein the mixing chamber (14) is located between the inlet nozzle (17*a*, 17*b*, 17'*b*, 17"*b*) and discharge opening (21), in which components (A, B) are mixed together, wherein the device (100) has a fixed base (101) with two perpendicularly standing, columnar braces (106, 107) connected by a transverse brace (108) in the upper area, between which is situated a support plate (104') that forms a filler head (104) and has mounts and receptacles for a supply tank (90) for binder component (A) and for three supply tanks (91, 92, 92') for hardener components (B, B1, B2) with plunger rods (243, 244, 245, 245') guided in the supply tanks (90, 91, 92, 92') and connected with hydraulic cylinders or other motorized drive units (102, 270), wherein there are provided an attachment and guiding element for the plunger rods above the supply tanks (90, 91, 92, 92'), and a first drive unit (102) for actuating the hydraulic cylinders or plunger rods for the supply tank (90) for binder component (A) and for two supply tanks (91, 92) of the three supply tanks (91, 92, 92') for hardener components (B, B1, B2), and a second drive unit (250) for the mixing device (1), and a third drive unit (270) for actuating the hydraulic cylinder or plunger rods (112) preferably designed as a toothed rack for the third supply tank (92') for hardener component (B2), wherein the motorized drive units (102, 250, 270) are combined in a program controller or control device (280) in such a way that, prior to the start of the mixing process and actuation of the hydraulic cylinders or plunger rods for the supply tank (90) for binder component (A) and for the two supply tanks (91, 92) for binder components (B, B1), the third drive unit (270) for the third supply tank (92') for hardener component (B2) is put into operation independently of all other functions, so that the start of the of the actual mixing process is preceded by a first running of hardener component (B2) for about 1 second, wherein once the rotor section (19) of the mixing device (1) has begun to rotate and binder component (A) and hardener components (B, B1) start to be supplied, the third drive unit (270) for the third supply tank (92') for hardener component (B2) is operated for an additional 1 second of last running to supply more hardener component (B2), wherein, following the complete evacuation of the third supply tank (92') for hardener component (B2) and once a toothed rack as the plunger rod (245') driven by the third drive unit (270) situated in a box-like container (285) on the transverse brace (108) of the two braces (106, 107) of the fixed base (101) has reached the lower area of the third supply tank (92') for hardener component (B2), it continues moving downward, hoisting the box-like container (285) hinged on one side to the longitudinal brace (106) in such way as to lift the box-like container (285) roughly 2 mm, wherein this movement of the box-like container (285) activates an optical signaling device (290) and deactivates the entire system or device for changing out the empty third supply tank (92') for hardener component (B2) for a full supply tank.

2. The device according to claim 1, wherein the fixed base (101) of the device (100) designed as a support plate for holding the supply tank (90) for binder component (A) and the three supply tanks (91, 92, 92') for hardener components (B, B1, B2), wherein the four supply tanks (90, 91, 92, 92') are positioned skidproof or immovably secured onto the filler head (104), and their outlet openings correspond to inlet openings (207, 208, 209, 209') of supply channels (204, 205, 206, 206') in the filler head (104), the outlet openings (201, 202, 203, 203') of which can be made to actively interact with the inlet nozzles (17*a*, 17*b*, 17'*b*, 17"*b*) for binder component (A) and for hardener components (B, B1, B2) of the mixing device (1), or with the inlet nozzles (231, 232, 232') for hardener components (B, B1, B2) of a collection tank (230) that can replace the mixing device (1) for collecting and disposing the quantity of hardener components (B, B1, B2) caused by overflow in the supply tanks (91, 92, 92') for hardener components (B, B1, B2), and wherein the interiors (90, 91*a*, 92*a*, 92'*a*) of the supply tanks (90, 91, 92, 92') exhibit the plate-shaped plungers (240, 241, 242, 242') that act on the container contents, with plunger rods (243, 244, 245, 245') that can be moved in the longitudinal direction of the container by means of motorized hydraulic cylinders or drive units of another design, or through manual activation, and can be used to force the contents in the supply tanks (90, 91, 92, 92') for binder component (A) and for hardener components (B, B1, B2) into the mixing device (1), or partial contents of the supply tanks (91, 92, 92') for hardener components (B, B1, B2) into the collection tank (230).

3. The device according to claim 1, wherein the collection tank (230) consists of a most preferably unilaterally closed molded part (235) with a beaker-shaped, cylindrical or other geometric cross sectional shape, whose wall (235*c*) exhibits two adjacent connecting pipes (231, 232) joined with the interior space (235*b*) of the molded part (235), which are arranged and designed in such a way that the collection tank (230) can be attached to the filler head (104) by means of the connecting pipes (231, 232) that can be introduced into the outlet openings (202, 203) of the filler head (104) for the hardener component (B, B1).

4. The device according to claim 1, wherein the wall surface (235*c*) of the molded part (235) of the collection tank (23) opposite the connecting pipes (231, 232, 232') exhibits a connecting pipe (234), into which the handle or clamping device (103) provided on the device (100) or the drive shaft of the drive for the mixing device (1) engage to hold and center the collection tank (230).

5. The device according to claim 1, wherein the plunger rods (110, 111, 112) are joined with their plate-shaped plungers (240, 241, 242) via a handle (260) for manual actuation.

6. The device according to claim 1, wherein the mixing device (1) exhibits a hollow cylindrical stator section (16) and a rotor section (19) accommodated therein so that it can rotate concentrically around a longitudinal axis (20), and the mixing chamber (14) is formed between the rotor section (19) and stator section (16) as an annular gap, with several first mixing teeth (23) molded onto the stator section (16) extending radially inward, and several second mixing teeth (24) molded onto the rotor section (19) extending radially outward into the mixing chamber (14), so that the rotational motion of the rotor section (19) in the stator section (16) moves the mixing teeth (23, 24) against each other, mixing components (A, B), wherein the stator section (16) exhibits three inlet openings (17*b*, 17'*b*, 17"*b*) connected with the mixing chamber for hardener components (B, B1, B2).

7. The device according to claim 1, wherein the end (16*a*) of the stator section (16) facing away from the inlet openings (17*a*, 17*b*, 17'*b*, 17"*b*) carries an annular mount (120), which has attachment openings (121), and is detachably and rotatably attached with the stator section (16) like a bayonet catch, wherein the rotating ability is limited by stops (122, 123; 122*a*, 123*a*) in such a way as to make the inlet opening (17*a*) for binder component (A) fit the feeder for binder component (A), and simultaneously make the inlet openings (17*b*, 17'*b*, 17"*b*) for hardener components (B, B1, B2) fit the feeders for the hardener components.

8. The device according to claim 7, wherein the annular mount (120) exhibits two opposing slotted openings (125; 135) that curve parallel to the circumferential edge of the mount (120), wherein each slotted opening (125; 135) exhibits two guiding sections (125*a*, 125*b*; 135*a*, 135*b*) of varying width, of which the respectively wider guiding section (125*a*, 135*a*) is designed for introducing an L-shaped guiding cam (140; 140') molded onto the lower circumferential edge (16*a*) of the stator section (16), while the width of the wider guiding section (125*a*, 135*a*) corresponds to the length of the free, angled leg (140*a*; 140'*a*) of the guiding cam (140; 140'), and of which the respectively narrower guiding section (125*b*; 135*b*) exhibits a width corresponding to the thickness of the leg (140*b*; 140'*b*) of the L-shaped guiding cam (140; 140') molded onto the lower circumferential edge (16*a*) of the stator section (16) and running parallel to the longitudinal direction of the mixing device (1).

9. The device according to claim 1, wherein the respective outer wall area (125*c*; 135*c*) of the narrower guiding section (125*b*; 135*b*) exhibits web-like wall sections (125*d*, 135*d*) accompanied by the formation of tongue-like edge areas (127, 137), with groove-like recesses having a depth roughly corresponding to the thickness of the angled leg (140*a*, 140'*a*)

of the L-shaped guiding cam (140, 140'), wherein the number of L-shaped guiding cams can be greater than two L-shaped guiding cams.

10. The device according to claim 1, wherein the annular mount (120) is made of a plastic or metal.

11. The device according to claim 1, wherein the first mixing teeth (23) are arranged at least on a first mixing tooth plane (10), and the second mixing teeth (24) are arranged at least on a second mixing tooth plane (11), and the mixing tooth planes (10, 11) are axially staggered relative to each other in levels in the direction of the longitudinal axis (20), so that the second mixing teeth (24) of the rotor section (19) radially rotate in the respective gaps of the first mixing teeth (23) of the stator section (16).

12. The device according to claim 1, wherein the mixing teeth (23, 24) each have front lateral surfaces (30, 31) that each face each other in an axial direction, so as to be positioned relative to each other given an axial force between the stator section (16) and rotor section (19).

13. The device according to claim 12, wherein the front lateral surfaces (30, 31) are inclined at an angle ($\alpha$) in relation to a plane situated normal to the rotational axis, so that the front lateral surfaces (30, 31) glide against each other during the mixing process without the mixing teeth (23, 24) stripping away material and allowing it into the mixing material.

14. The device according to claim 1, wherein the end of rotor section (19) exhibits projections (22), which extend into the inlet opening (17*a*) for supplying the binder component (A) and co-rotate with the rotation of the rotor section (19), so as to reduce the thixotropy of the binder component (A) already in the supply channel of the inlet opening (17*a*).

15. The device according to claim 1, wherein the end of the rotor section (19) has an open, hollow cylindrical-type recess 929), in which a geometrically adjusted core can be placed for driving the rotor section (19).

16. The device according to claim 15, wherein the recess (29) exhibits latching ribs (25) that run radially inward from the body of the rotor section (19), latching into corresponding recesses in the core, so as to convey the drive torque for operating the mixing device (1) from the rotationally driven core to the rotor section (19).

17. The device according to claim 1, wherein the rotor section (19) exhibits sealing lips (26) to seal the mixing chamber (14) between the rotor section (19) and stator section (16), and prevent material from exiting.

18. The device according to claim 17, wherein a cavity (28) is formed between the sealing lips (26), so as to catch the mixing material that passes though the sealing lips (26).

19. The device according to claim 18, wherein the periphery of the stator section (16) exhibits at least one outlet opening (13) in the cylindrical section of the cavity (28), so as to prevent mixing material from exiting from the cylindrical bearing section (27).

20. The device according to claim 17, wherein the molded part (235) of the collection tank (230) consists of a plastic or other suitable material.

21. The device according to claim 1, wherein the stator section (16) exhibits at least a plate-shaped molding (18) on the outer periphery, wherein at least one plate-shaped molding (18) encompasses a crescent-shaped latching contour (15), into which a pin element engages when incorporating the mixing device (1), so as to secure the radial position of the discharge opening (21) in the stator section (16).

22. The device according to claim 1, wherein the rotor section (19) exhibits a cylindrical bearing section (27) to produce a sliding bearing arrangement in the stator section (16) for purposes of radial mounting.

23. The device according to claim 1, wherein the stator section (16) encompasses a support bearing surface (12), against the face of which the rotor section (19) with molded-on mixing teeth (24) abuts and slides to create an axial sliding bearing arrangement.

24. The device according to claim 1, wherein at least the stator section (16) is made of a transparent material, wherein the transparent material comes from the group of plastics encompassing a polycarbonate (PC), a polymethylmethacrylate (PMMA) and/or a styrene-acrylonitrile (SAN).

25. The device according to claim 1, wherein the supporting frame exhibits an openable, preferably transparent protective cover (200) to cover the supply tanks (90, 91, 92, 92'), wherein it is especially preferred to have a protective switch that interacts with the protective cover (200) and device (100), which deactivates the device (100) if the protective cover is open, wherein the latter can consist of a clear plastic or other suitable material, and is designed as a door.

26. The device according to claim 1, wherein the supporting frame of the device (100) has receiving tanks (300, 301) front and/or back for holding spent or new mixing devices (1).

27. The device according to claim 1, wherein the supporting frame of the device (100) visually exhibits an optical signaling device (350) connected with the power source, such as a signaling lamp (351) that emits a white light or color light and/or an acoustic signaling device (360), such as a signal horn or siren (361), wherein both signaling devices (350, 360) are activated during startup of the device (100) for a prescribed period, most preferably for two or three minutes, by lighting up and/or emitting a signal.

28. The device according to claim 27, wherein the signaling device (360) is activated even given an empty indication for the supply tank (92') for hardener component (B2).

* * * * *